US010297932B2

(12) United States Patent
Maesoba et al.

(10) Patent No.: US 10,297,932 B2
(45) Date of Patent: May 21, 2019

(54) CONNECTOR STRUCTURE

(71) Applicants: AUTONETWORKS TECHNOLOGIES, LTD., Yokkaichi-shi, Mie (JP); Sumitomo Wiring Systems, Ltd., Yokkaichi-shi, Mie (JP); SUMITOMO ELECTRIC INDUSTRIES, LTD., Osaka-shi, Osaka (JP); TOYOTA JIDOSHA KABUSHIKI KAISHA, Toyota-shi, Aichi-ken (JP)

(72) Inventors: Hiroyoshi Maesoba, Yokkaichi (JP); Toshifumi Ichio, Yokkaichi (JP); Kimiyasu Okumura, Yokkaichi (JP); Hiroshi Kobayashi, Toyota (JP); Motoya Hara, Toyota (JP); Ryutaro Yamazaki, Toyota (JP)

(73) Assignees: AutoNetworks Technologies, Ltd. (JP); Sumitomo Wiring Systems, Ltd. (JP); Sumitomo Electric Industries, Ltd. (JP); Toyota Jidosha Kabushiki Kaisha (JP)

( * ) Notice: Subject to any disclaimer, the term of this patent is extended or adjusted under 35 U.S.C. 154(b) by 0 days.

(21) Appl. No.: 15/728,838

(22) Filed: Oct. 10, 2017

(65) Prior Publication Data

US 2018/0102597 A1 Apr. 12, 2018

(30) Foreign Application Priority Data

Oct. 12, 2016 (JP) ..... 2016-200514

(51) Int. Cl.
*H01R 13/502* (2006.01)
*H01R 9/03* (2006.01)
(Continued)

(52) U.S. Cl.
CPC ..... *H01R 9/035* (2013.01); *H01R 9/0518* (2013.01); *H01R 11/11* (2013.01);
(Continued)

(58) Field of Classification Search
CPC ..... H01R 13/5808; H01R 13/5816; H01R 13/58; H01R 13/5833; H01R 13/658;
(Continued)

(56) References Cited

U.S. PATENT DOCUMENTS 4,702,538 A * 10/1987 Hutter ..... H01R 24/84 439/292
6,106,325 A * 8/2000 Kuo ..... H01R 13/5808 439/455
(Continued)

FOREIGN PATENT DOCUMENTS

JP H09161895 A 6/1997
JP 2010-27435 2/2010
(Continued)

OTHER PUBLICATIONS

Japanese Offic Action dated Oct. 9, 2018.

*Primary Examiner* — Hien D Vu
(74) *Attorney, Agent, or Firm* — Gerald E. Hespos; Michael J. Porco; Matthew T. Porco

(57) ABSTRACT

The connector structure selectively uses either a UTP connector or an STP connector. The UTP connector includes UTP connection terminals connected to respective electric wires of a UTP cable and a UTP dielectric having a pair of housing portions in which the UTP connection terminals are housed. The STB connector includes STP connection terminals connected to respective electric wires of an STP cable and an STP dielectric having a pair of housing portions in which the STP connection terminals are housed. In the UTP dielectric, at least a partition wall for partitioning the
(Continued)

pair of housing portions is made of a material having a relatively high dielectric constant. In the STP dielectric, at least a partition wall for partitioning the pair of housing portions is made of a material having a relatively low dielectric constant.

6 Claims, 25 Drawing Sheets

(51) Int. Cl.

| | |
|---|---|
| ***H01R 9/05*** | (2006.01) |
| ***H01R 11/11*** | (2006.01) |
| ***H01R 13/6583*** | (2011.01) |
| ***H01R 13/659*** | (2011.01) |
| ***H01R 13/6593*** | (2011.01) |
| ***H01R 24/60*** | (2011.01) |
| ***H01R 13/6477*** | (2011.01) |
| *H01R 9/24* | (2006.01) |
| *H01R 13/66* | (2006.01) |
| *H01R 107/00* | (2006.01) |
| *H01R 24/56* | (2011.01) |

(52) U.S. Cl.
CPC ..... *H01R 13/6477* (2013.01); *H01R 13/659* (2013.01); *H01R 13/6583* (2013.01); *H01R 13/6593* (2013.01); *H01R 24/60* (2013.01); *H01R 9/2416* (2013.01); *H01R 13/6658* (2013.01); *H01R 24/568* (2013.01); *H01R 2107/00* (2013.01)

(58) Field of Classification Search
CPC .. H01R 13/562; H01R 13/514; H01R 13/506; H01R 13/518; H01R 13/516
USPC ..... 439/455, 456, 686, 687, 701, 731
See application file for complete search history.

(56) References Cited

U.S. PATENT DOCUMENTS

| | | | | |
|---|---|---|---|---|
| 6,255,613 | B1 * | 7/2001 | Yang | H01H 9/0228 200/553 |
| 6,435,732 | B1 * | 8/2002 | Asao | G02B 6/387 385/78 |
| 8,771,016 | B2 * | 7/2014 | Atkinson | H01R 13/6598 439/607.07 |
| 8,894,448 | B2 * | 11/2014 | Affeltranger | H01R 4/2433 439/701 |

FOREIGN PATENT DOCUMENTS

| | | |
|---|---|---|
| JP | 2012-195315 | 10/2012 |
| JP | 5087487 | 12/2012 |
| JP | 2013097955 A | 5/2013 |
| JP | 5333632 | 8/2013 |

* cited by examiner

CONNECTOR STRUCTURE

CROSS-REFERENCE TO RELATED APPLICATIONS

This application is based upon and claims the benefit of priority from the prior Japanese Patent Application No. 2016-200514 filed on Oct. 12, 2016, the entire contents of which are incorporated herein by reference.

BACKGROUND

Field of the Invention

The present invention relates to a connector structure.

Description of the Related Art

Conventionally, twisted pair cables obtained by twisting a plurality of electric wires have been suitably used in in-vehicle networks and the like because they are less affected by noise and they provide less noise radiation than mere parallel wires. The twisted pair cables are known to include STP (shielded twisted pair) cables and UTP (unshielded twisted pair) cables. Among these cables, the STP cables have electric wires whose periphery is surrounded by a shield conductor, and have stronger resistance to noise.

For example, JP 5333632 B2 discloses a connector including inner conductor terminals which are connected to an end of an STP cable, an inner housing (dielectric) which houses the inner conductor terminals, a shield shell which is connected to a shield conductor of the STP cable and surrounds the inner housing, and an outer housing which houses the shield shell.

JP 5087487 B2 discloses a connector including connection terminals which are connected to an end of a UTP cable and a connector body (dielectric) having a terminal housing part which houses the connection terminals.

SUMMARY

The connectors of JP 5333632 B2 and JP 5087487 B2 have a common structure that the electric wires of the UTP cable or the STP cable are connected to the terminals and the terminals are housed in the dielectric. In this case, if the STP cable can be replaced with the UTP cable or vice versa by making use of the common structural portion in these connectors, the design of a die can be rendered easy and the cost can be reduced. However, there are circumstances that the UTP cable and the STP cable are incompatible with each other in principle, and are different in impedance.

The present invention was made based on the above circumstances, and an object thereof is to provide a connector structure in which an STP cable and a UTP cable can be replaced with each other without any major structural change.

The present invention relates to a connector structure which selectively uses either a UTP connector or an STP connector. The UTP connector includes UTP connection terminals connected to respective electric wires of the UTP cable and a UTP dielectric having a pair of housing portions in which the UTP connection terminals are housed. The STP connector includes STP connection terminals connected to respective electric wires of the STP cable and an STP dielectric having a pair of housing portions in which the STP connection terminals are housed. In the UTP dielectric, at least a partition wall for partitioning the pair of housing portions is made of a material having a relatively high dielectric constant, and in the STP dielectric, at least a partition wall for partitioning the pair of housing portions is made of a material having a relatively low dielectric constant.

A material having a high dielectric constant is used at least as the material for the partition wall of the UTP dielectric, and a material having a low dielectric constant is used at least as the material for the partition wall of the STP dielectric, thereby making it possible to relatively decrease the impedance on the UTP cable side and to relatively increase the impedance on the STP cable side. Thus, impedance can properly be adjusted between the UTP cable side and the STP cable side without major changes of the structures of the UTP dielectric and the STP dielectric, and the two cables can be easily replaced with each other.

DETAILED DESCRIPTION

Hereinafter, preferred embodiments of the present invention will be described.

Each partition wall can preferably be attached to, and detached from, each body of the UTP dielectric and the STP dielectric. By virtue of this, impedance can be adjusted only by changing the material for the partition wall.

EXAMPLES

Example 1

Example 1 of the present invention will be described based on the drawings. A connector structure of Example 1 is used in in-vehicle communication network systems, and can selectively use either a UTP connector 20A which is provided at an end of a UTP cable 10A or an STP connector 20B which is provided at an end of an STP cable 10B. The UTP connector 20A and the STP connector 20B have a structural portion common or similar to each other, and it is made possible to replace the UTP cable 10A and the STP cable 10B with each other while adjusting the impedance.

Figure 1:
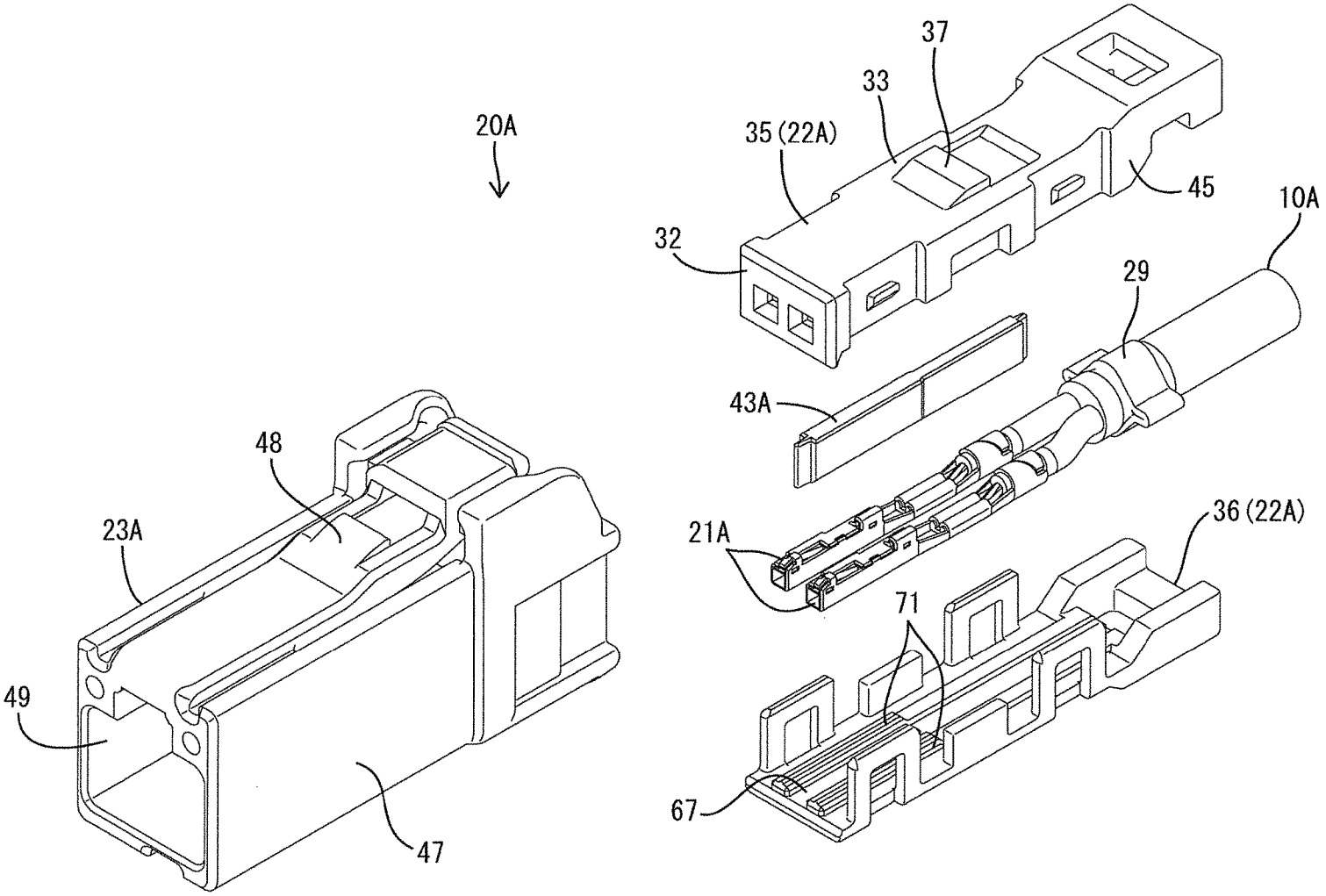
FIG. 1 is an exploded perspective view of a UTP connector of Example 1 according to the present invention.
Figure 13:
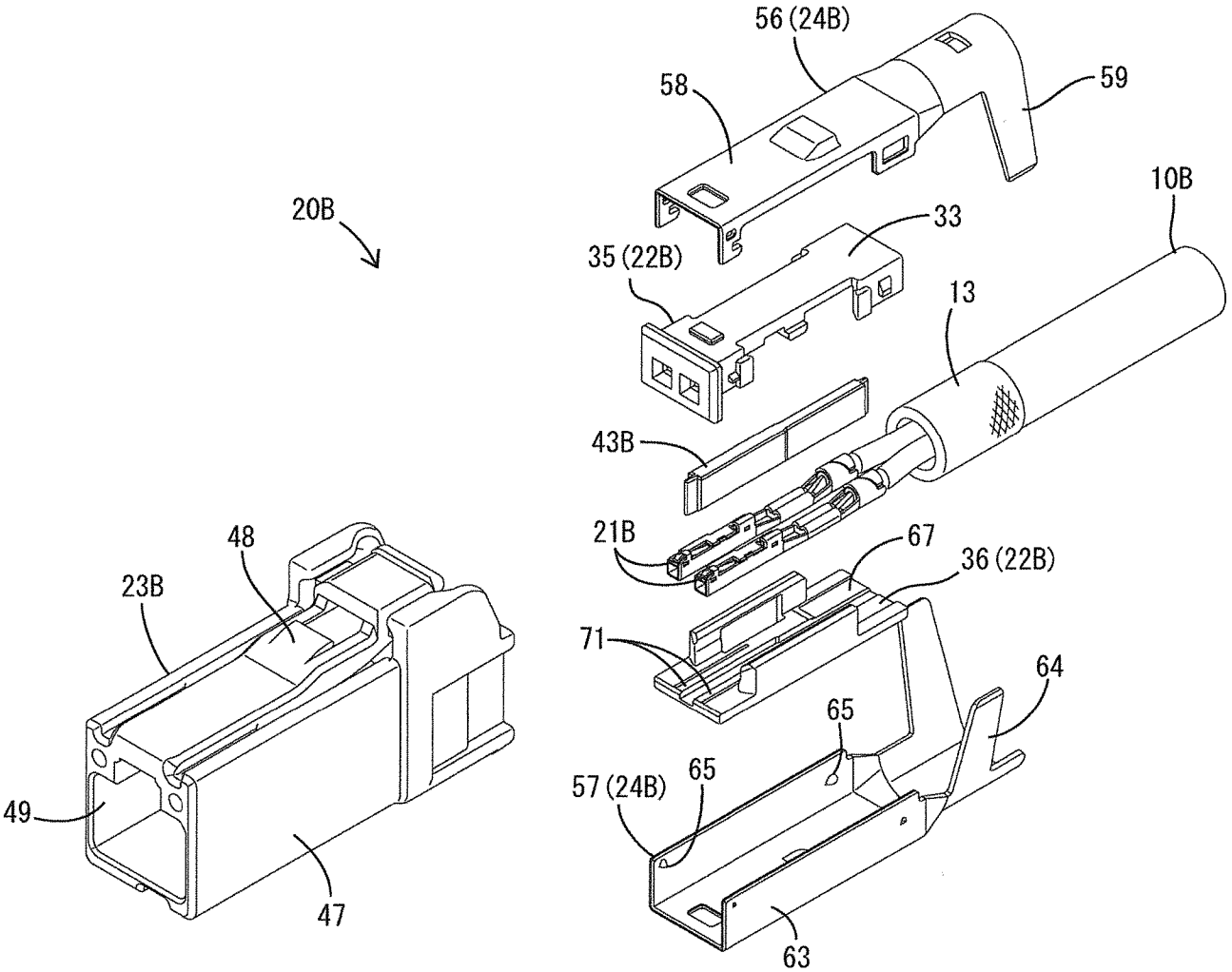
FIG. 13 is an exploded perspective view of the STP connector.

The UTP connector 20A is fitted with a counterpart UTP connector (not shown), and includes UTP connection terminals 21A, a UTP dielectric 22A and a UTP housing 23A as shown in FIG. 1. The STP connector 20B is fitted with a counterpart STP connector (not shown), and includes STP connection terminals 21B, an STP dielectric 22B, an outer conductor 24B and an STP housing 23B as shown in FIG. 13.

[UTP Cable]

Figure 4:
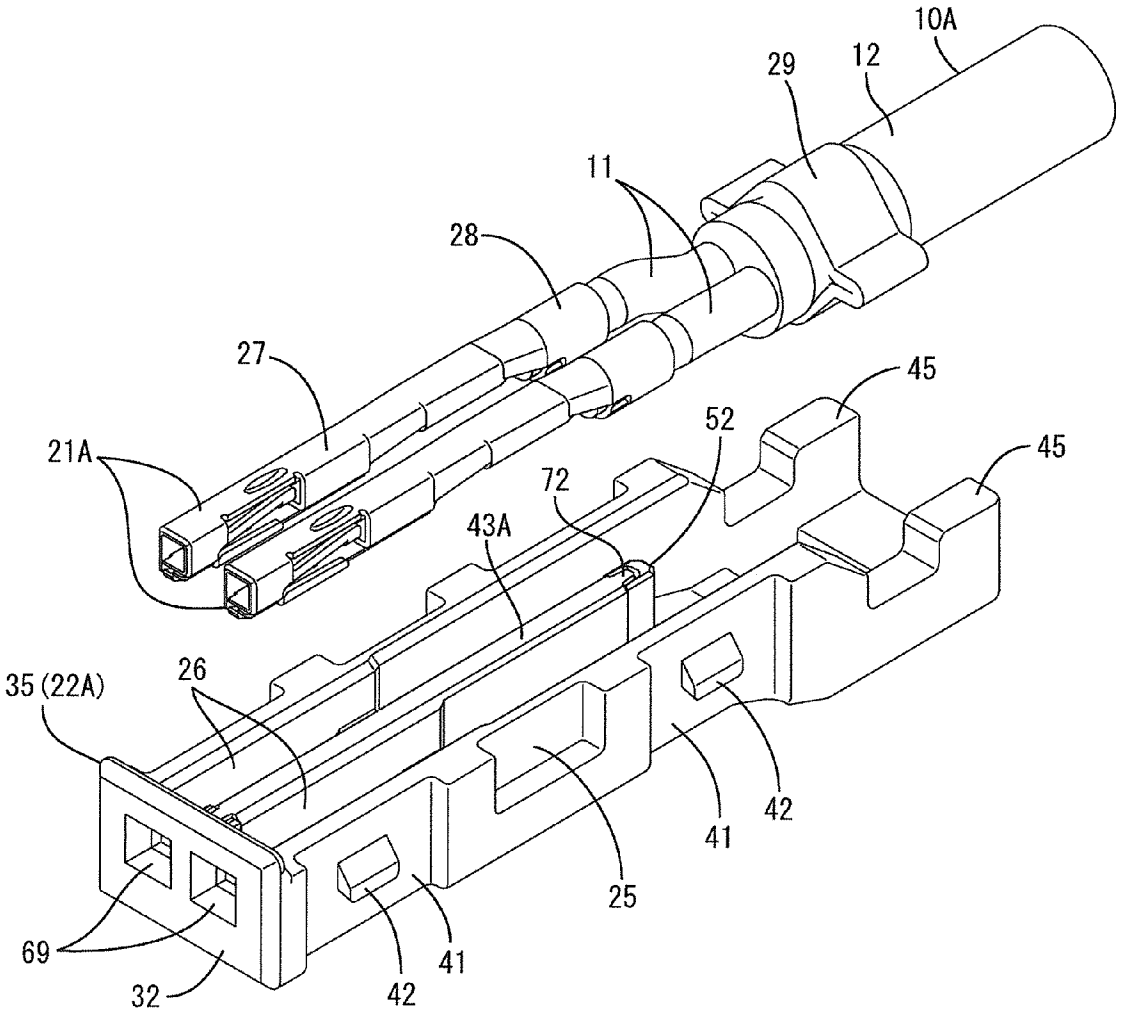
FIG. 4 is an exploded perspective view showing UTP connection terminals connected to electric wires of the UTP cable, and the upper dielectric.

As shown in FIG. 4, the UTP cable 10A includes a pair of twisted electric wires 11 and a sheath 12 which surrounds the electric wires 11. The electric wires 11 are each composed of a conductor portion and a covering portion which surrounds the conductor portion. The ends of the electric wires 11 are exposed from the sheath 12 and respectively connected to the UTP connection terminals 21A.

[UTP Connection Terminal]

Figure 11:
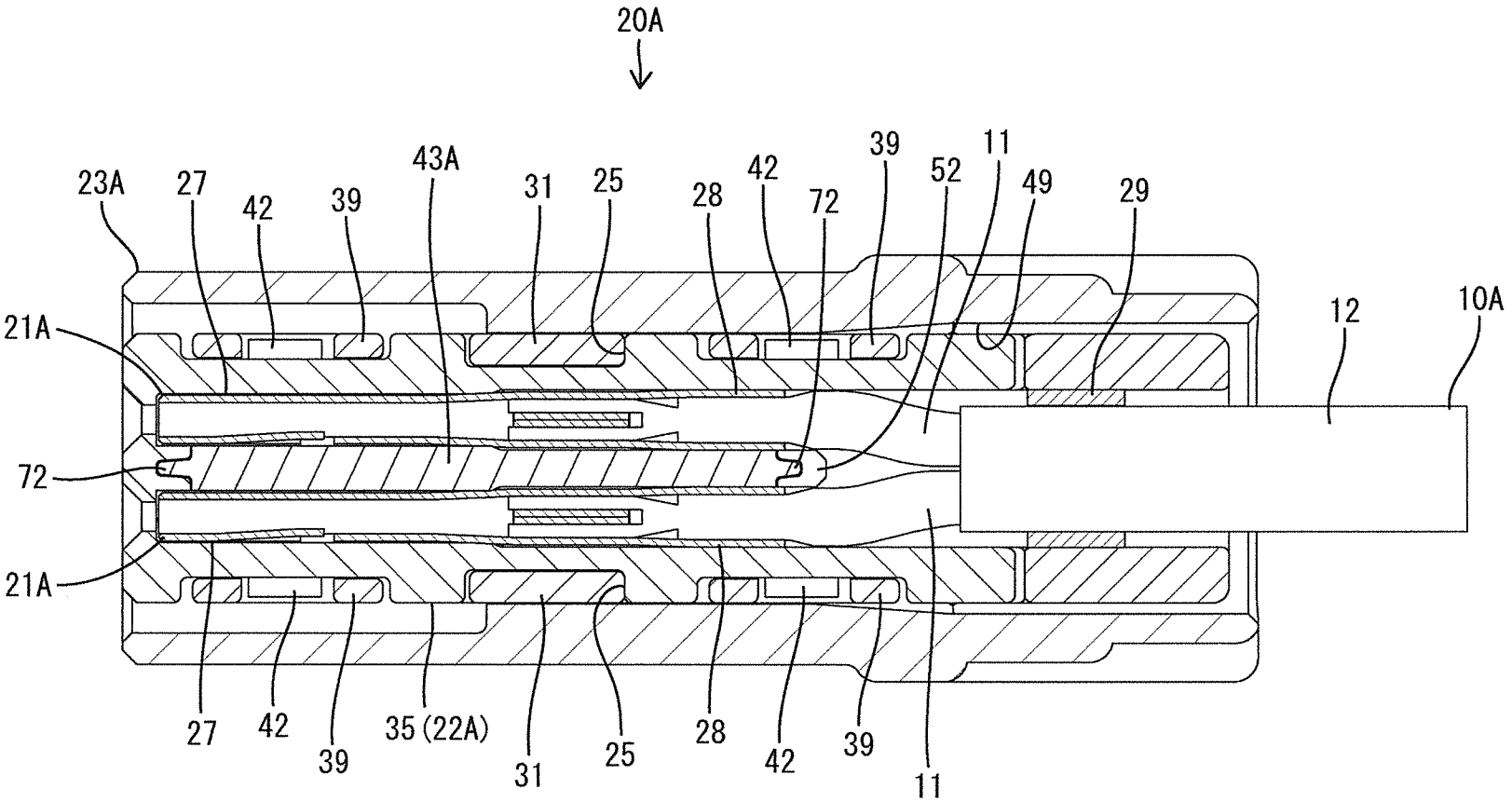
FIG. 11 is a cross sectional view of the UTP connector in a plan view direction.

The UTP connection terminals 21A connected to the respective electric wires 11 of the UTP cable 10A are constructed in the same shape. When the UTP connector 20A and the counterpart UTP connector are fitted with each other, the UTP connection terminals 21A are electrically connected to male tabs (not shown) which are provided in the counterpart UTP connector. Each UTP connection terminal 21A is integrally formed, for example, by bending a conductive metal plate material, and formed in an elongate shape in the front-back direction (the right and left direction in FIG. 11), as a whole.

The UTP connection terminal 21A includes a front end having a substantially square-cylindrical shaped box portion 27 and a rear end having an open barrel-shaped barrel portion 28. The male tab is inserted in, and electrically connected to, the box portion 27. The barrel portion 28 is electrically and mechanically connected to the conductor portion and covering portion of the electric wire 11. Furthermore, the UTP connection terminal 21A has a protrusion (not shown) which protrudes upward from one side of the box portion 27. A crimping ring 29, which is a component different from the UTP connection terminal 21A, is crimped and connected to an end of the sheath 12 of the UTP cable 10A.

[UTP Dielectric]

The UTP dielectric 22A is made of a synthetic resin, and made of the same material as that of the STP dielectric 22B, except partition walls 43A, 43B which will be described later, and includes an upper dielectric 35 and a lower dielectric 36 which can be divided in the up-down direction. In the following description, FIG. 2 to FIG. 8 are intended to explain the assembling procedures, and are opposite to FIG. 1 in terms of the reference of the up-down direction.

Figure 2:
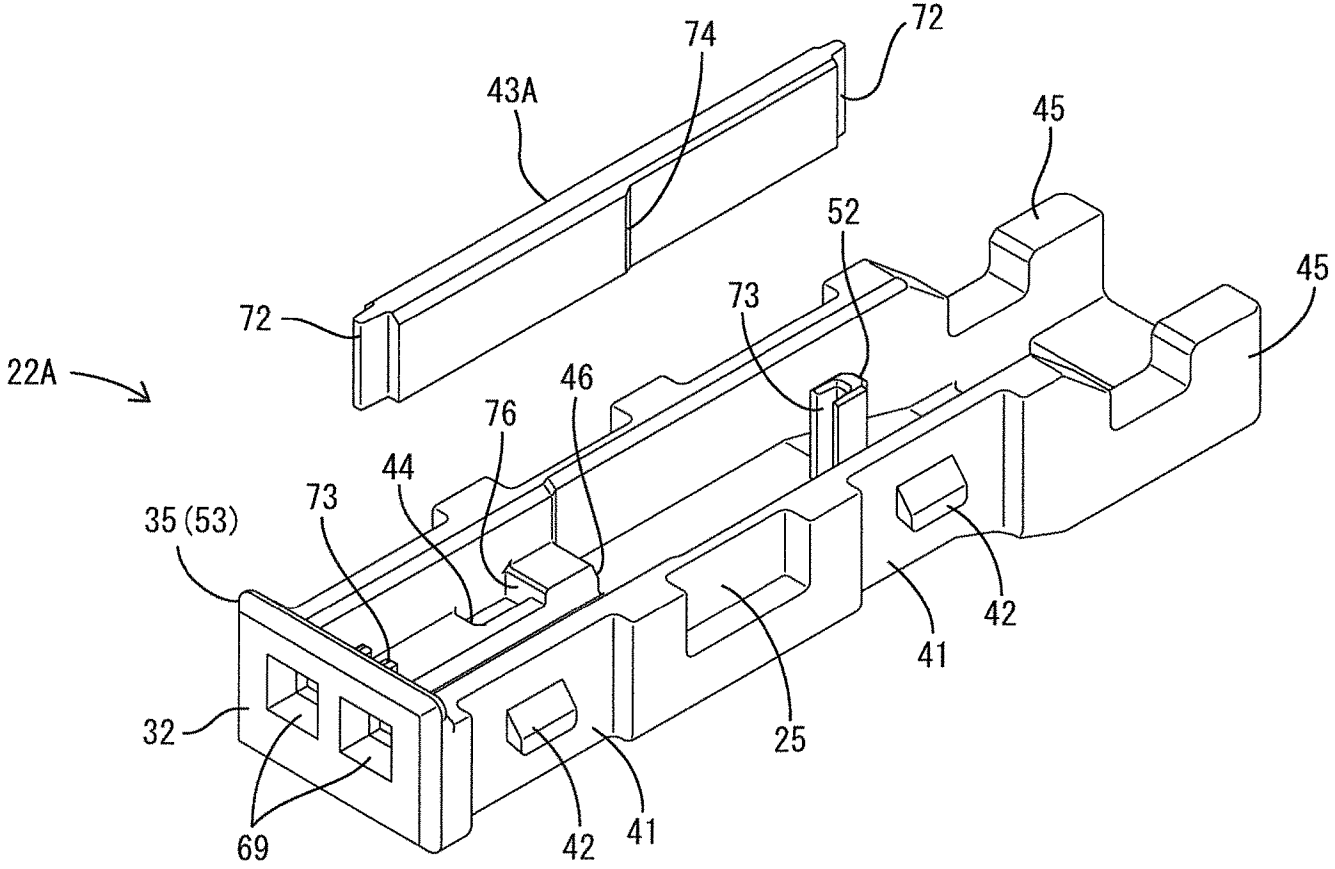
FIG. 2 is an exploded perspective view showing a partition wall and an upper dielectric in the UTP connector.

As shown in FIG. 2, the upper dielectric 35 has a body 53 and a partition wall 43A which can be attached to, and detached from, the body 53.

The partition wall 43A is made of a material having a higher dielectric constant (specific dielectric constant) than that of the partition wall 43B, as will be described later, of the STP dielectric 22B, for example, a liquid crystal polymer (LCP). The partition wall 43A has a plate shape long in the front-back direction, and has a step 74 in its center part in the front-back direction, and its substantially half front part, via the step 74, is formed slightly thick relative to its substantially half rear part. At both front and rear ends of the partition wall 43A, strip-shaped tenons 72 are provided respectively so as to protrude in both front and back directions.

The body 53 includes an upper wall 33 positioned at its upper end, a pair of right and left side walls 45 positioned at its right and left ends respectively, and a front wall 32 positioned at its front end.

Figure 10:
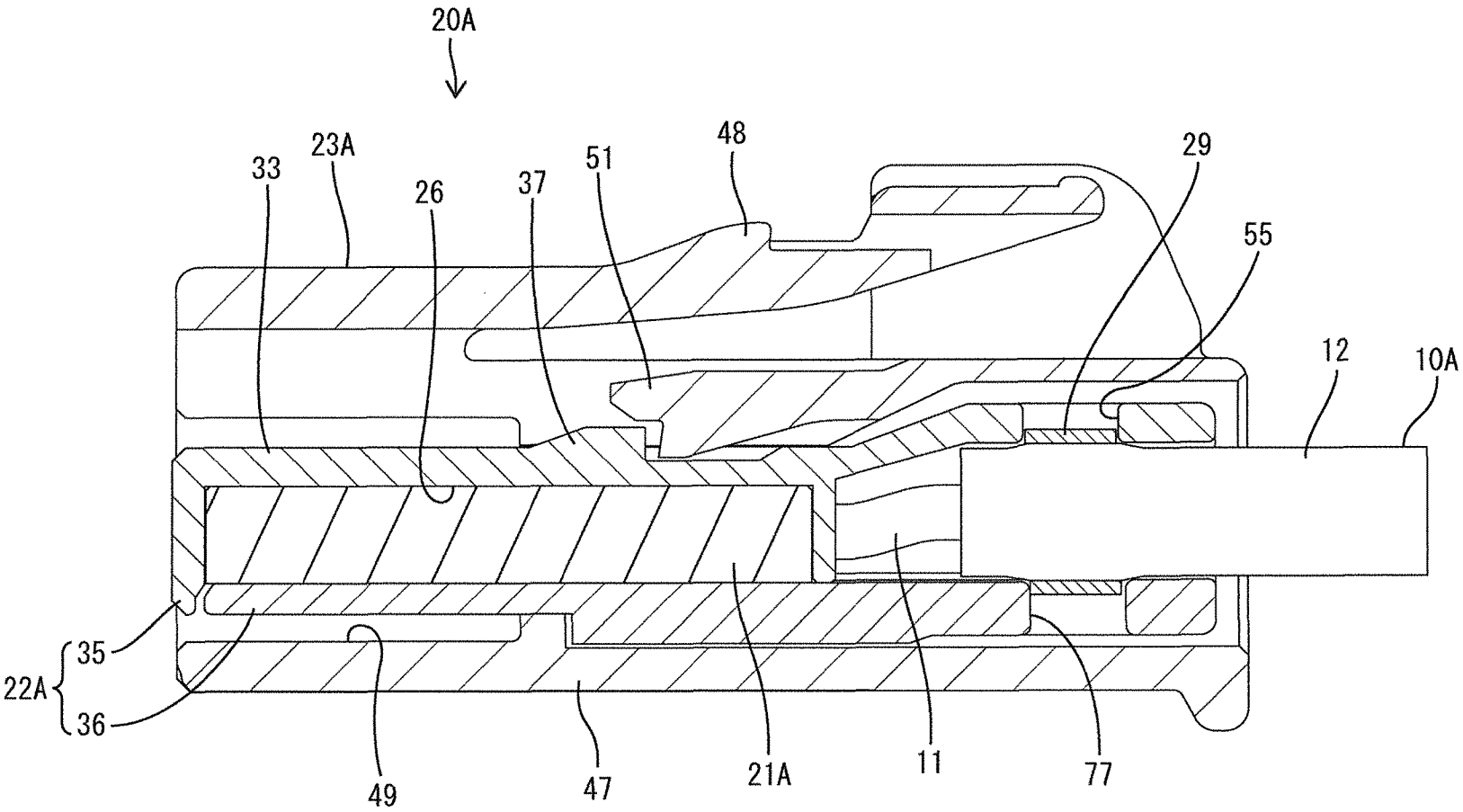
FIG. 10 is a cross sectional view of the UTP connector in a side view direction.

As shown in FIG. 10, the outer surface (upper surface) of the upper wall 33 is provided with a lock protrusion 37 which is engageable with the UTP housing 23A. In the rear end of the upper wall 33, an upper end escape hole 55 for letting the upper end of the crimping ring 29 escape is provided to be opened.

Figure 12:
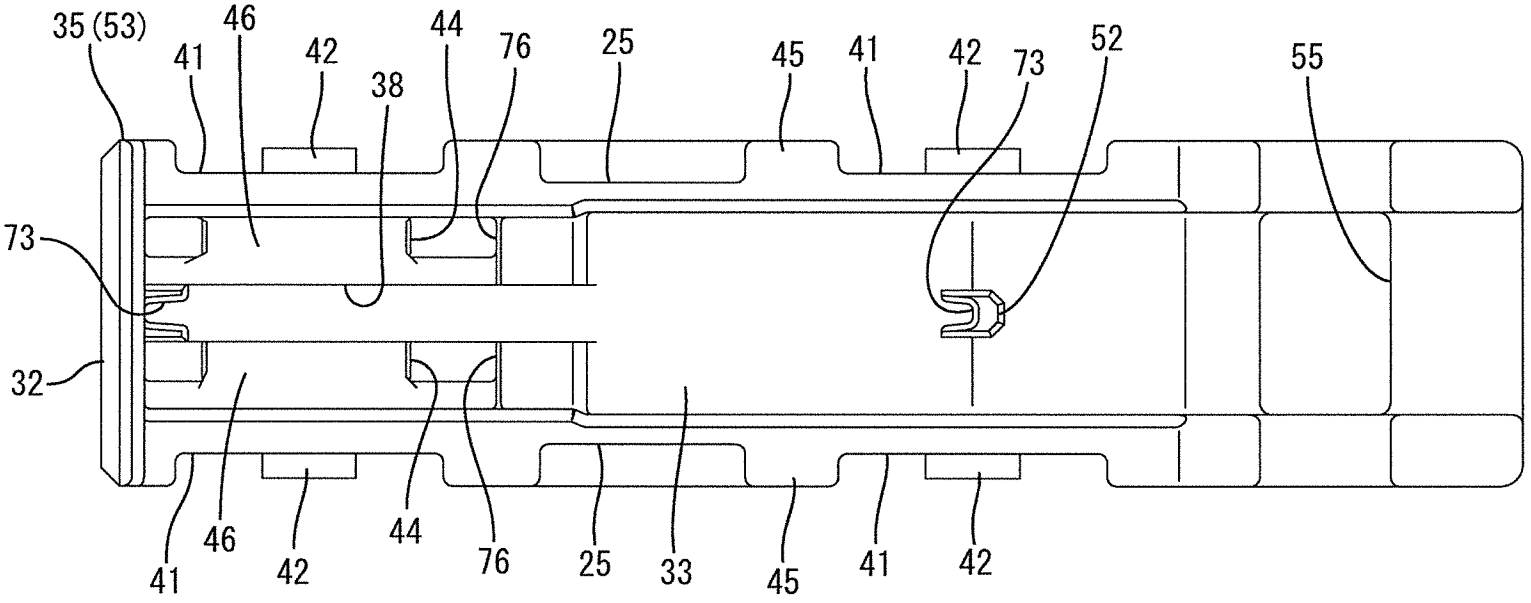
FIG. 12 is a bottom view of a body of the upper dielectric in the UTP connector.

As shown in FIG. 12, a pair of right and left retaining portions 46, which can retain the partition wall 43A in a positioned state, is provided on the inner surface (lower surface) of the upper wall 33. The respective retaining portions 46 are formed in a rib shape along the front-back direction in the front end of the inner surface of the upper wall 33, and disposed in parallel with each other with the fitting groove 38 being sandwiched therebetween. The lower surface of each retaining portion 46 is provided with a shallow recess 76 which is brought in contact with the box portion 27 of the UTP connection terminal 21A to determine the longitudinal position of the box portion 27. At the rear end of the recess 76, a concave portion 44 is provided to be opened into which the protrusion of the UTP connection terminal 21A is to be inserted.

On the rear side of the fitting groove 38 in the inner surface of the upper wall 33, a pin-shaped positioning protrusion 52 is provided which defines the rear end position of the partition wall 43A. At the front end of the positioning protrusion 52, a mortise groove 73 having a substantially U-shaped cross section is provided so as to extend over the overall height of the up-down direction (protruding direction). Another mortise groove 73 is also provided in a rib-shaped portion which extends in the up-down direction on the rear surface of the front wall 32. The longitudinal position of the fitting groove 38 is defined by both mortise grooves 73.

Figure 5:
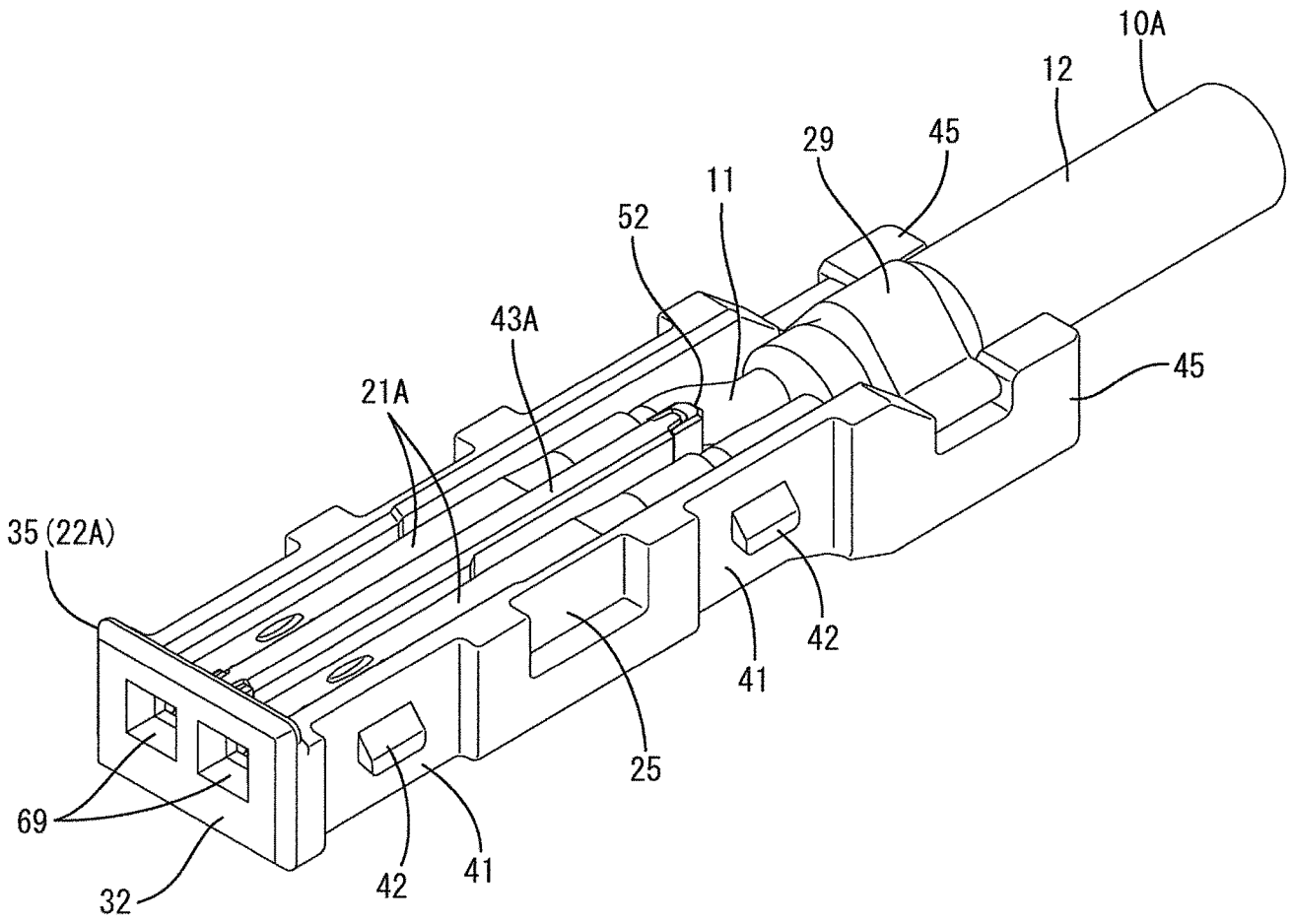
FIG. 5 is a perspective view showing a state where the UTP connection terminals connected to the respective electric wires of the UTP cable are housed in housing portions of the upper dielectric.

The substantially half front part of the partition wall 43A is fitted into the fitting groove 38 and held between the retaining portions 46, and the front and rear tenons 72 are fitted and held in the corresponding mortise grooves 73, whereby the partition wall 43A is mounted in the body 53. As shown in FIG. 4, in a state where the partition wall 43A is mounted in the body 53, a pair of housing portions 26 is formed on both right and left sides of the partition wall 43A in the upper dielectric 35. As shown in FIG. 5, the UTP connection terminals 21A are housed in the respective housing portions 26 in a fitted state, and the housed UTP connection terminals 21A are disposed in parallel with each other with the partition wall 43A being sandwiched therebetween.

The outer surfaces of the side walls 45 are provided with front and rear pairs of square-concave mounting receiving portions 41, and each receiving portion 41 is provided with a mounting protrusion 42 on its inner surface. Furthermore, on the outer surfaces of the side walls 45, positioning recesses 25 are each provided between the front and rear mounting receiving portions 41 so as to be opened downward. In the front wall 32A, a pair of right and left tab insertion holes 69 is provided to be opened, and the male tabs are inserted into the tab insertion holes 69 from the front side in a positioned state.

Figure 6:
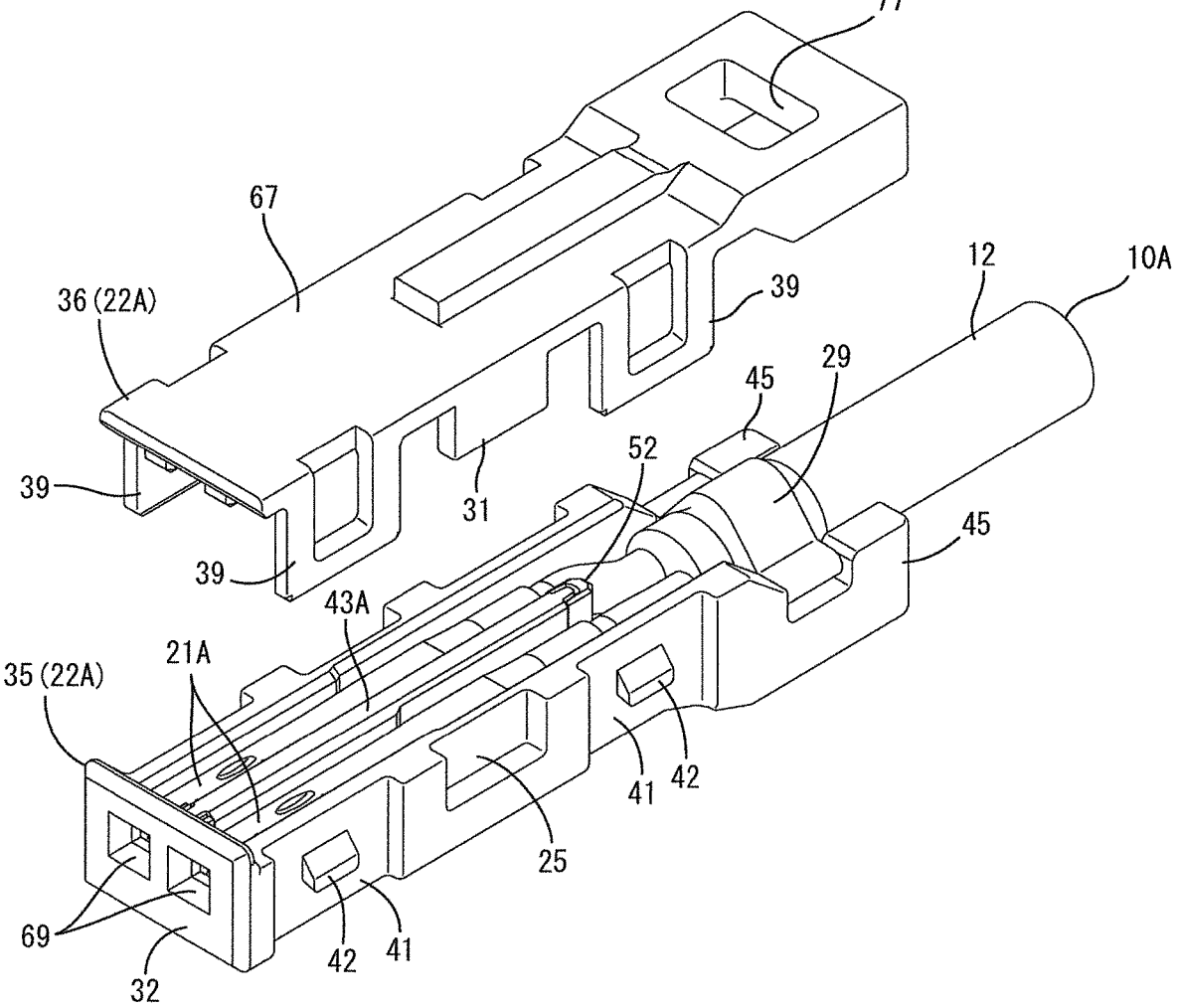
FIG. 6 is an exploded perspective view showing the upper dielectric in which the UTP connection terminals are housed, and a lower dielectric.
Figure 7:
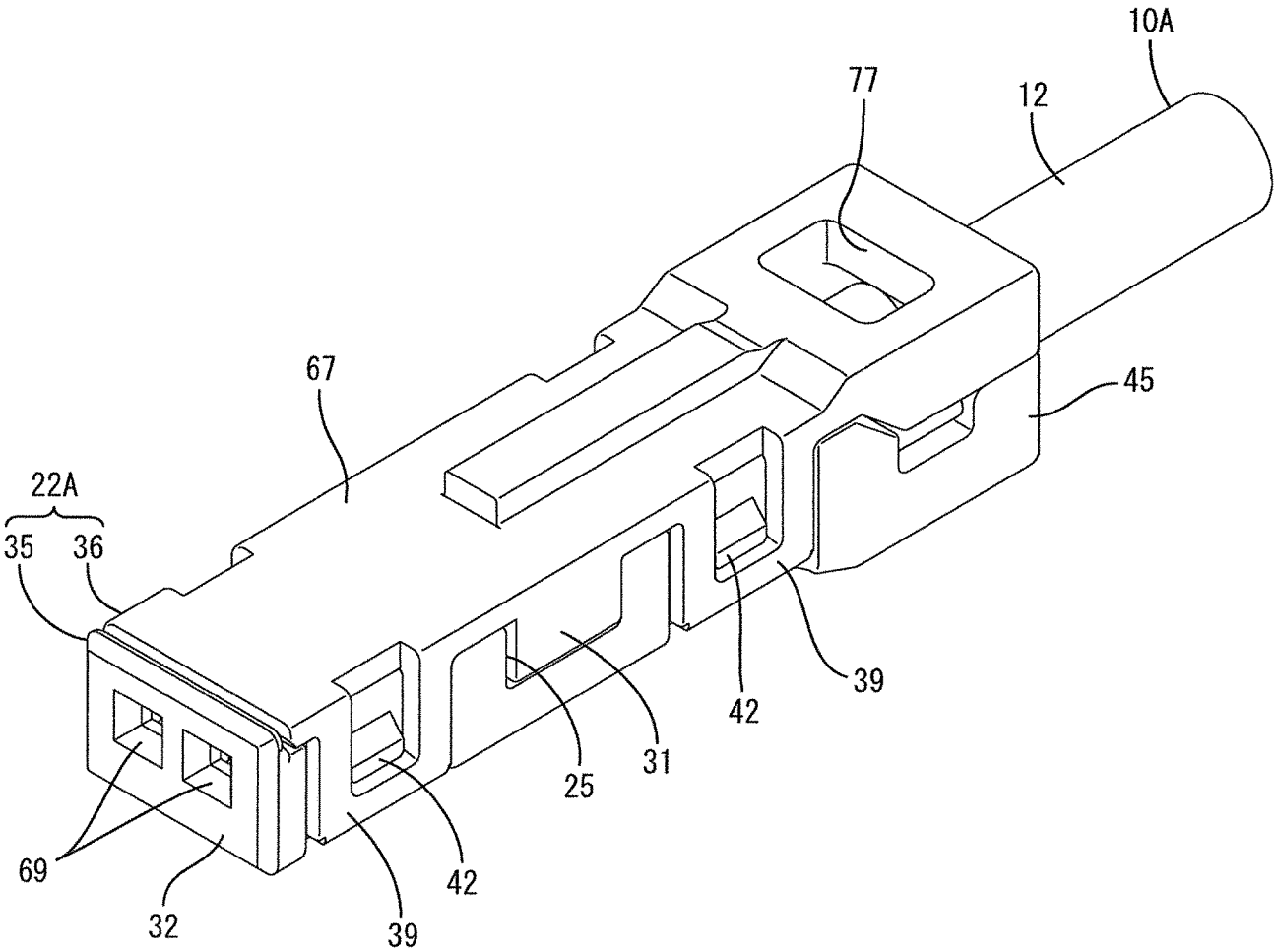
FIG. 7 is a perspective view of the UTP dielectric in which the lower dielectric and the upper dielectric are held in an assembled state.

As shown in FIG. 6, the lower dielectric 36 has a flat plate-shaped support wall 67 which is long in the front-back direction. At the right and left ends of the support wall 67, front and rear pairs of portal frame-shaped mounting pieces 39 are provided so as to protrude upward, and plate piece-shaped positioning projecting pieces 31 are each provided between the front and rear mounting pieces 39 so as to protrude upward. As shown in FIG. 7, the respective positioning projecting pieces 31 are fitted and positioned in the positioning recesses 25, and the respective mounting pieces 39 are fitted to the mounting receiving portions 41 to be elastically engaged with the mounting protrusions 42, whereby the upper dielectric 35 and the lower dielectric 36 are held in an assembled state. Furthermore, the upper dielectric 35 and the lower dielectric 36 are assembled so that the partition wall 43A and UTP connection terminals 21A are restrained from coming out upward, and are held within the UTP dielectric 22A.

As shown in FIG. 1, the upper surface of the support wall 67 is provided with a pair of right and left support ribs 71 at positions opposite to the respective retaining portions 46 in the assembled state, and the lower end of the partition wall 43A is inserted between the support ribs 71 in a fitted state. In the rear end of the support wall 67, a lower end escape hole 77 for letting the lower end of the crimping ring 29 escape is provided to be opened.

[UTP Housing]

Figure 9:
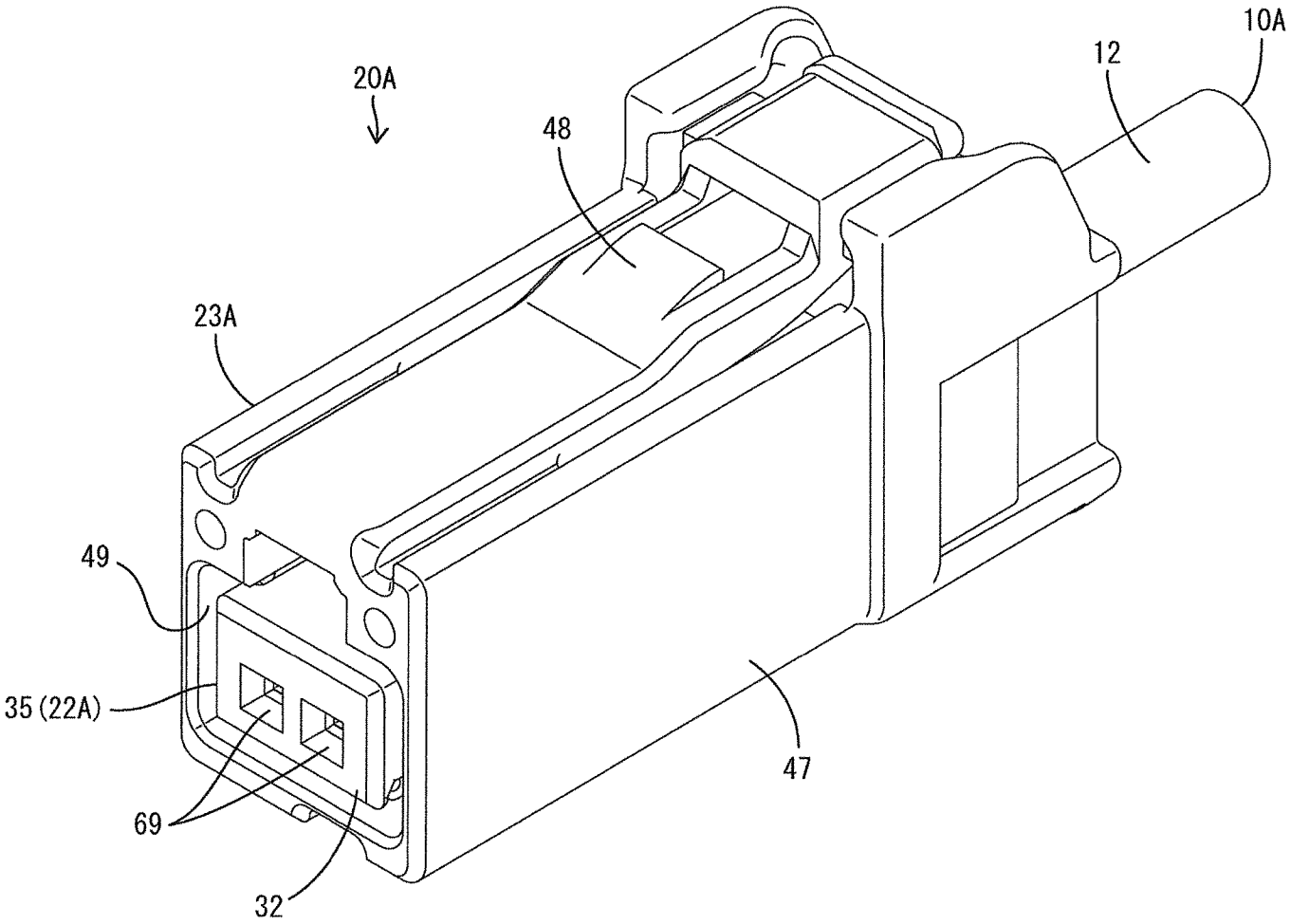
FIG. 9 is a perspective view of the UTP connector.

The UTP housing 23A is made of a synthetic resin, and, as shown in FIG. 9, has a substantially square-cylindrical shaped housing body 47. At the center part in the width direction of the upper surface of the housing body 47, a lock arm 48 is provided so as to protrude. The lock arm 48 is formed so as to extend rearward from the front end of the upper surface of the housing body 47 in a cantilever manner, and elastically engages the counterpart UTP connector to hold the UTP connector 20A and the counterpart UTP connector in a fitted state. Inside of the housing body 47, an insertion part 49 is provided so as to penetrate therethrough in the front-back direction. As shown in FIG. 10, the UTP dielectric 22A can be fitted into the insertion part 49. The upper surface of the inner wall of the insertion part 49A is provided with a lance 51 which protrudes frontward in a cantilever manner. The UTP dielectric 22A is inserted from the rear side into the insertion part 49 so that the lance 51 is flexibly deformed by the lock protrusion 37. Thereafter, the lance 51 returns and elastically engages the lock protrusion 37, so that the UTP dielectric 22A is retained in the UTP housing 23A.

[Counterpart UTP Connector]

Though not described in detail, the counterpart UTP connector has a hood part made of a synthetic resin, in which the UTP housing 23A can be fitted, and a pair of right and left male tabs is disposed in the hood part so as to protrude. Furthermore, the counterpart UTP connector is supported by a circuit board (not shown), and the respective male tabs are electrically connected to a conductive part of the circuit board.

[STP Cable]

Figure 15:
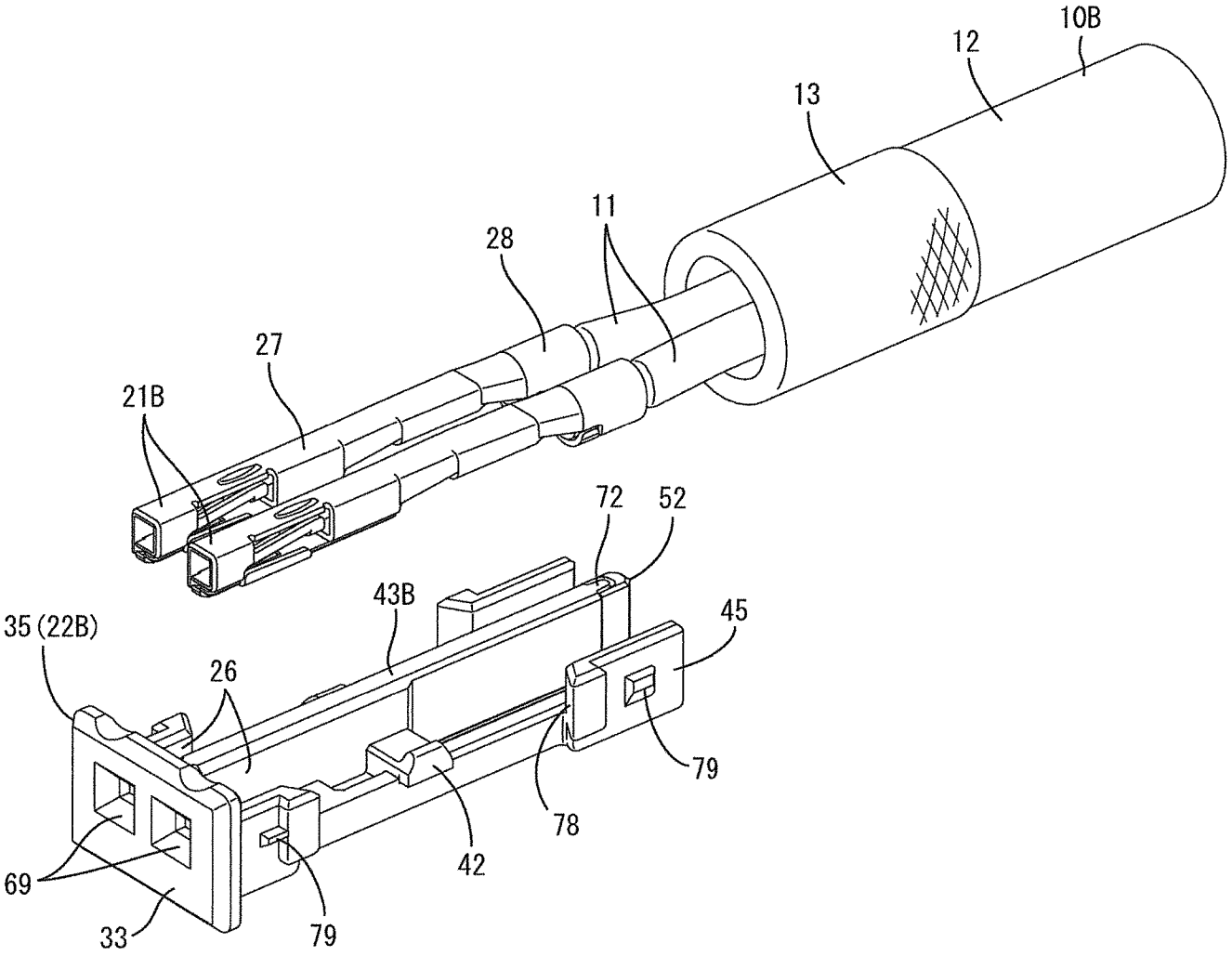
FIG. 15 is an exploded perspective view showing STP connection terminals connected to electric wires of an STP cable, and an upper dielectric.

As shown in FIG. 15, the STP cable 10B includes a pair of twisted electric wires 11, a shield conductor 13, such as a braided wire, which surrounds and shields the electric wires 11 and a sheath 12 which surrounds the shield conductor 13. The ends of the respective electric wires 11 and the end of the shield conductor 13 are exposed from the sheath 12, and, among these ends, the end of the shield conductor 13 is folded back to be adhered to the outer peripheral side of the sheath 12. The ends of the electric wires 11 are respectively connected to the STP connection terminals 21B.

[STP Connection Terminal]

The STP connection terminals 21B connected to the respective electric wires 11 of the STP cable 10B are constructed in the same shape. When the STP connector 20B and the counterpart STP connector are fitted with each other, the STP connection terminals 21B are connected to male tabs (not shown) which are provided in a counterpart STP connector. Each STP connection terminal 21B has the same shape as that of the UTP connection terminal 21A and has a box portion 27, a barrel portion 28 and a protrusion (not shown) in the same arrangement as that of the UTP connection terminal 21A.

[STP Dielectric]

The STP dielectric 22B is made of a synthetic resin, and includes an upper dielectric 35 and a lower dielectric 36 which can be divided in the up-down direction. No crimping ring 29 is provided in the STP connector 20B, so that the STP dielectric 22B does not require any structure to receive the crimping ring 29 and accordingly has a shorter longitudinal dimension than that of the UTP dielectric 22A. In the following description, FIG. 14 to FIG. 21 are intended to explain the assembling procedures, and are opposite to FIG. 13 in terms of the reference of the up-down direction.

Figure 14:
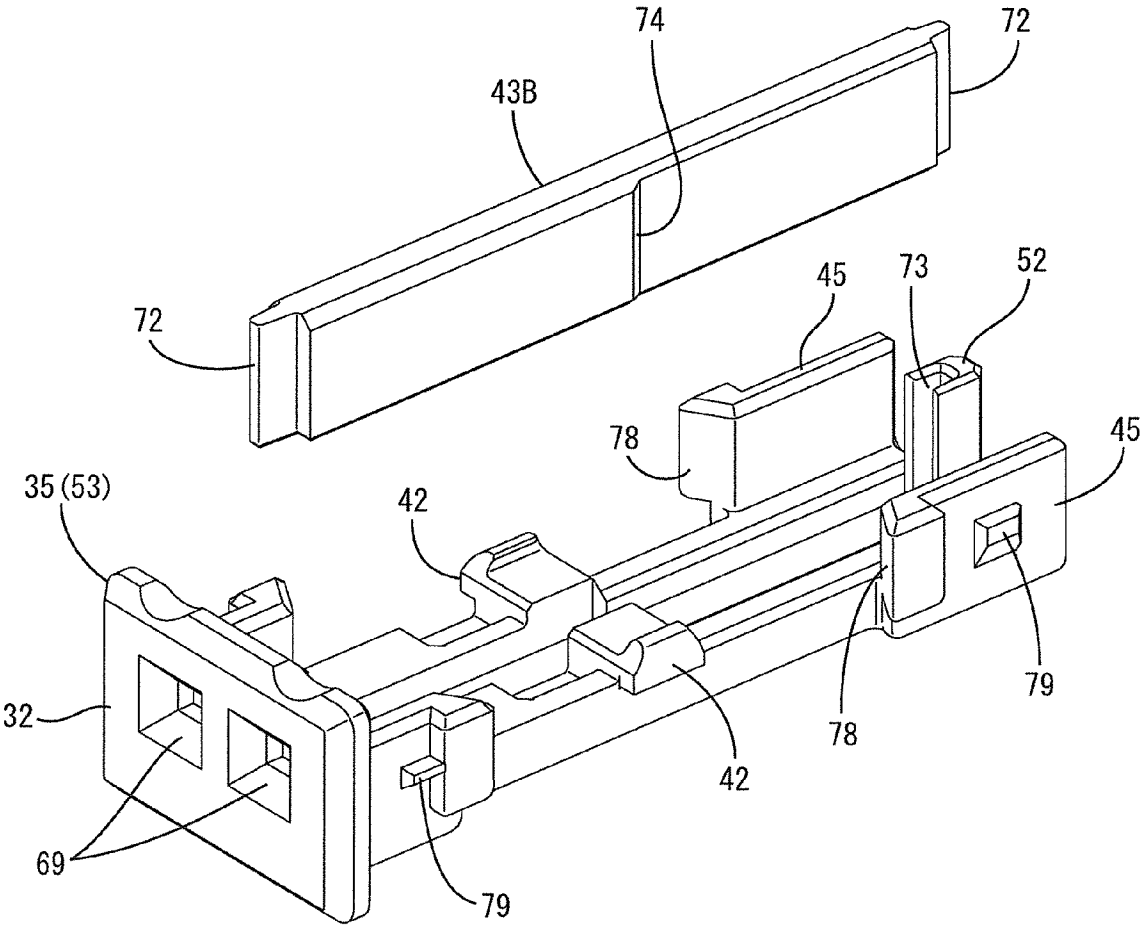
FIG. 14 is an exploded perspective view showing the partition wall and the upper dielectric in the STP connector.

As shown in FIG. 14, the upper dielectric 35 has a body 53 and a partition wall 43B which can be attached to, and detached from, the body 53.

The partition wall 43B is made of a material having a lower dielectric constant (specific dielectric constant) than that of the partition wall 43A of the UTP dielectric 22A, for example, polypropylene (PP). The partition wall 43B has the same shape as that of the partition wall 43A of the UTP dielectric 22A, and has a step 74 in its center part in the front-back direction, and has tenons 72 which protrude in both front and back directions respectively.

The body 53 includes an upper wall 33 positioned at its upper end, a pair of right and left side walls 45 positioned at its right and left ends respectively, and a front wall 32 positioned at its front end.

Figure 24:
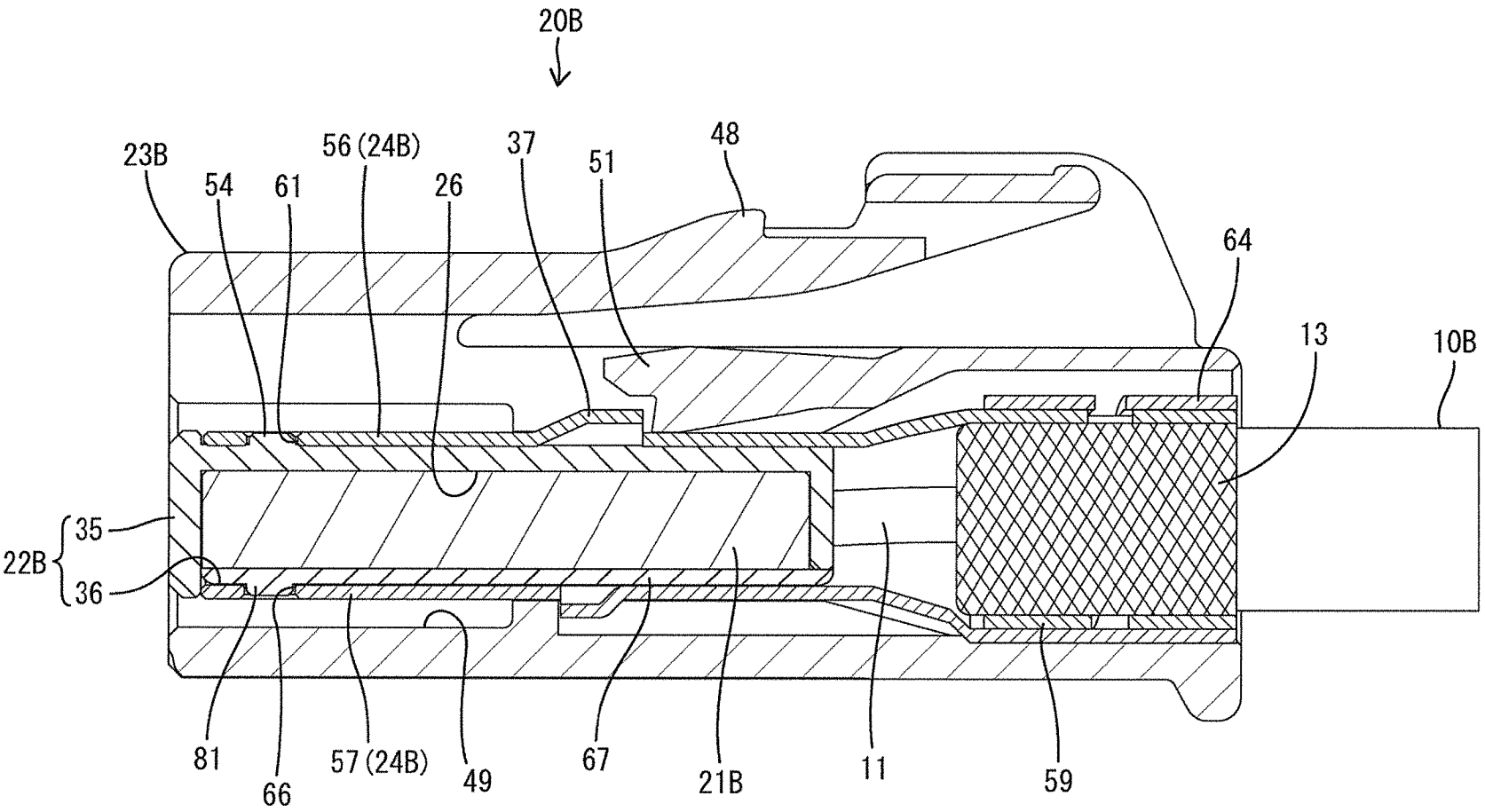
FIG. 24 is a cross sectional view of the STP connector in a side view direction.
Figure 25:
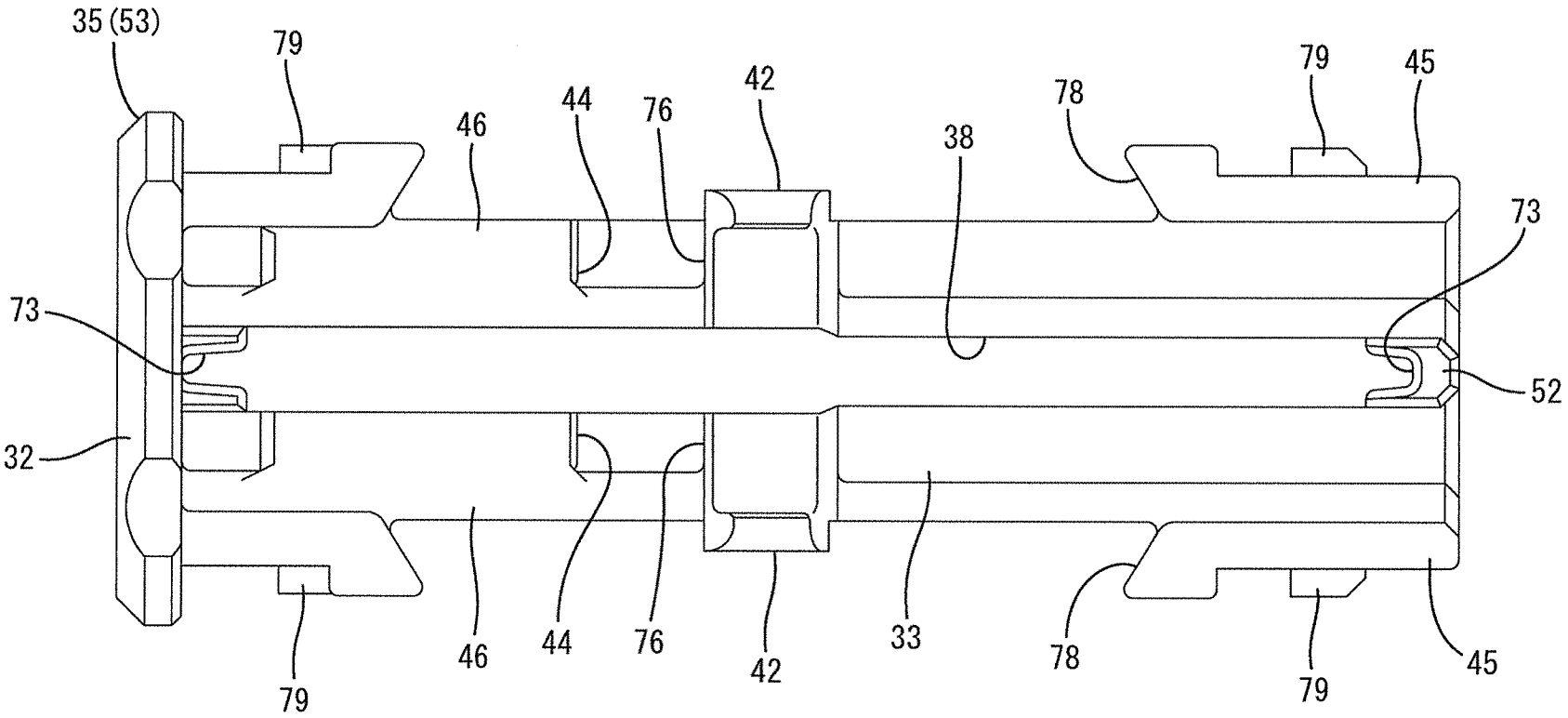
FIG. 25 is a bottom view of a body of the upper dielectric in the STP connector.

As shown in FIG. 24, the front end of the upper surface of the upper wall 33 is provided with an upper positioning protrusion 54 with respect to the outer conductor 24B. As shown in FIG. 25, the inner surface (lower surface) of the upper wall 33 has substantially the same structure as that of the UTP dielectric 22A, and retaining portions 46 are provided on both right and left sides of the fitting groove 38. The lower surface of each retaining portion 46 is provided with a recess 76, and a concave portion 44 is provided to be opened at the rear end of the recess 76. Furthermore, a positioning protrusion 52 is provided on the rear side of the fitting groove 38, and mortise grooves 73 are provided in the front surface of the positioning protrusion 52 and in a rib-shaped portion on the rear surface of the front wall 32 so as to be opposite to each other. In the case of the STP dielectric 22B, a positioning protrusion 52 is placed at the rear end of the inner surface of the upper wall 33.

Figure 16:
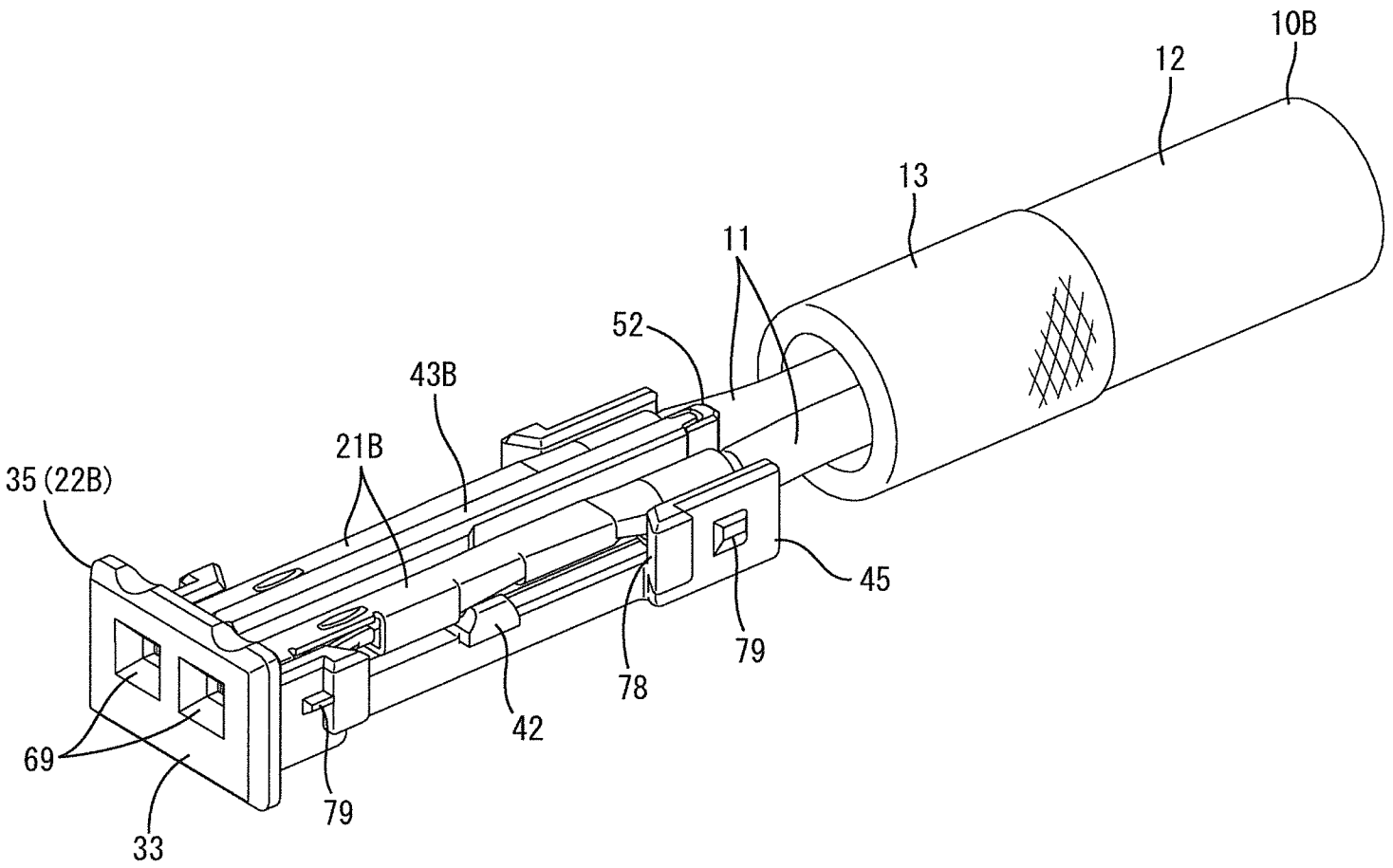
FIG. 16 is a perspective view showing a state where the STP connection terminals connected to the respective electric wires of the STP cable are housed in housing portions of the upper dielectric.

The substantially half front part of the partition wall 43B is fitted into the fitting groove 38 and held between the retaining portions 46, and the front and rear tenons 72 are fitted and held in the corresponding mortise grooves 73. As shown in FIG. 15, a pair of housing portions 26 is formed on both right and left sides of the partition wall 43B in the upper dielectric 35, and the STP connection terminals 21B are housed in the respective housing portions 26 in a fitted state as shown in FIG. 16. The housed STP connection terminals 21B are disposed in parallel with each other with the partition wall 43B being sandwiched therebetween.

Both side walls 45 are opened as cutouts 78 except for both front and rear ends thereof, and claw-shaped mounting protrusions 42 are provided in the center part of the cutouts 78 in the front-back direction so as to protrude. The cutouts 78 are also opened to both right and left ends of the upper wall 33. The outer surfaces of both front and rear ends of the side walls 45 are provided with engaging protrusions 79 with respect to the outer conductor 24B. In the front wall 32A, a pair of right and left tab insertion holes 69 is provided to be opened, and the male tabs are inserted into the tab insertion holes 69 from the front side in a positioned state.

Figure 17:
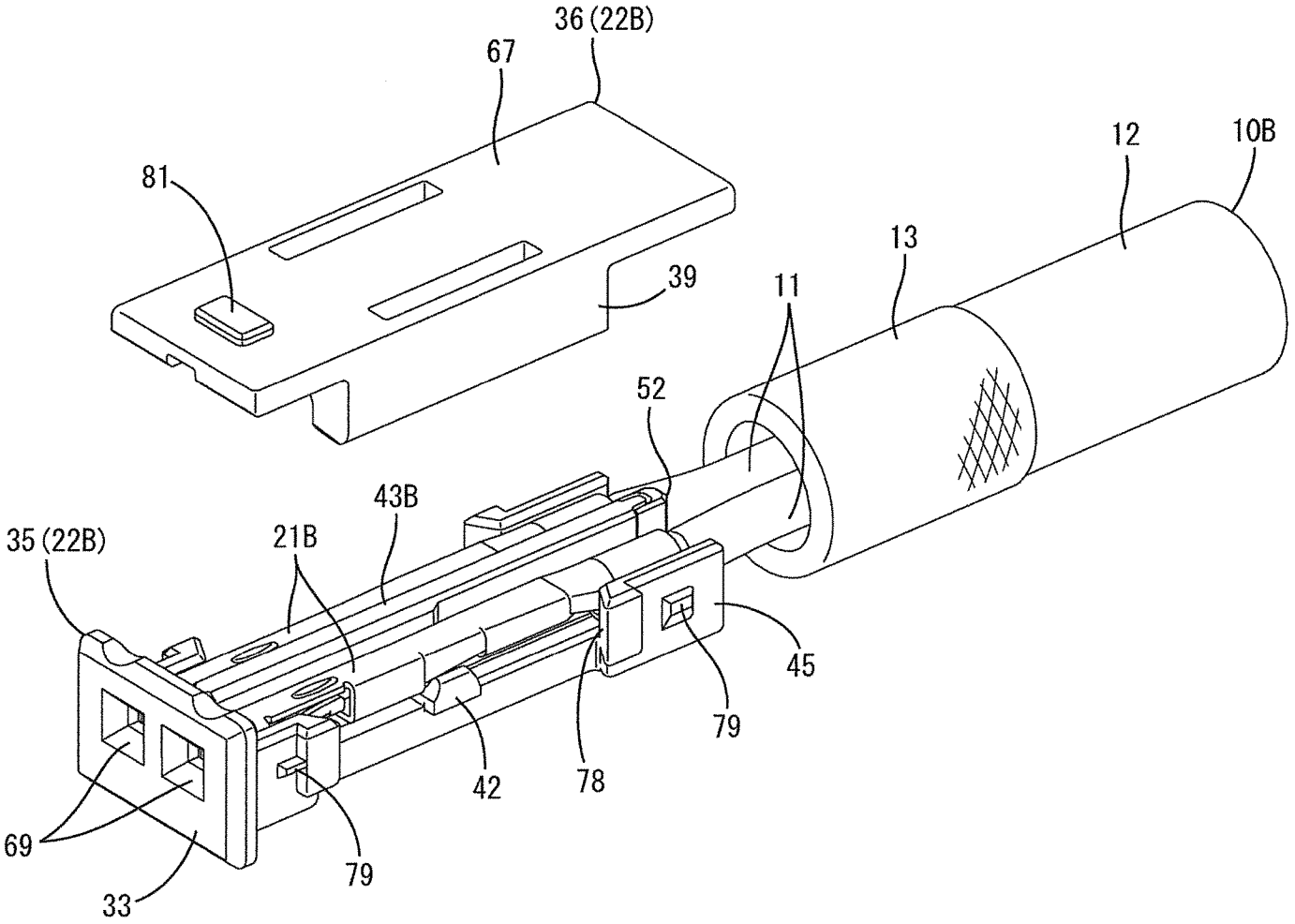
FIG. 17 is an exploded perspective view showing the upper dielectric in which the STP connection terminals are housed, and a lower dielectric.
Figure 18:
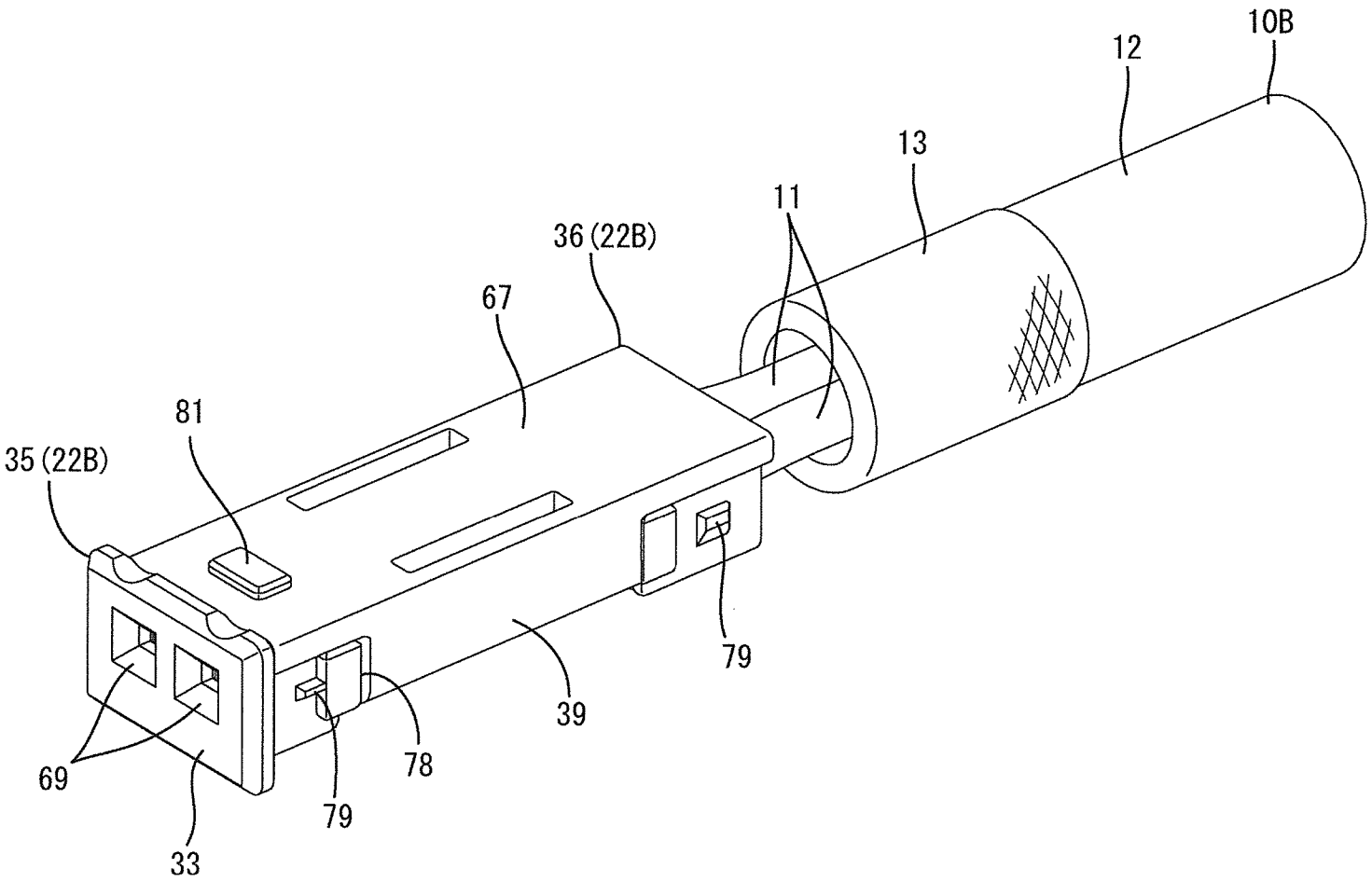
FIG. 18 is a perspective view of an STP dielectric in which the lower dielectric and the upper dielectric are held in an assembled state.

As shown in FIG. 17, the lower dielectric 36 includes a flat plate-shaped support wall 67 and a pair of mounting pieces 39 which erects from the center part in the front-back direction of both right and left ends of the support wall 67. The mounting pieces 39 are provided with recess portions in the inner surfaces thereof. As shown in FIG. 18, the mounting pieces 39 are fitted with the cutouts 78, and the mounting protrusions 42 are elastically engaged with the recess portions of the mounting pieces 39, so that the upper dielectric 35 and the lower dielectric 36 are held in an assembled state. The upper dielectric 35 and the lower dielectric 36 are assembled, so that the partition wall 43B and STP connection terminals 21B are restrained from coming out upward, and held within the STP dielectric 22B.

As shown in FIG. 13, on the upper surface of the support wall 67, a pair of right and left support ribs 71 is provided at positions opposite to the respective retaining portions 46 in the assembled state, and the lower end of the partition wall 43B is inserted between the support ribs 71 in a fitted state. As shown in FIG. 24, the front end of the lower surface of the support wall 67 is provided with a lower positioning protrusion 81 with respect to the outer conductor 24B.

[Outer Conductor]

Figure 19:
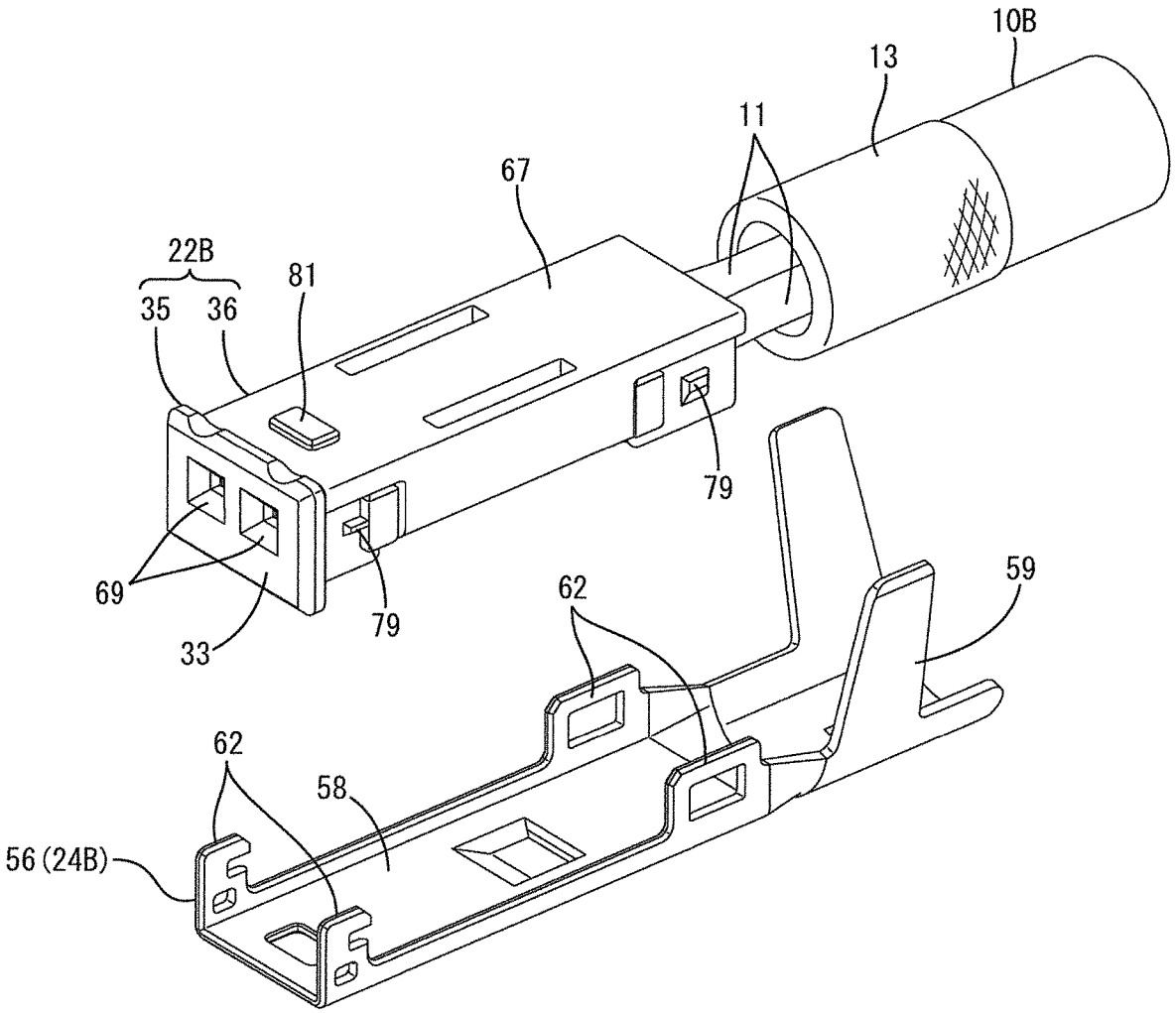
FIG. 19 is an exploded perspective view showing the STP dielectric and an upper outer conductor.
Figure 22:
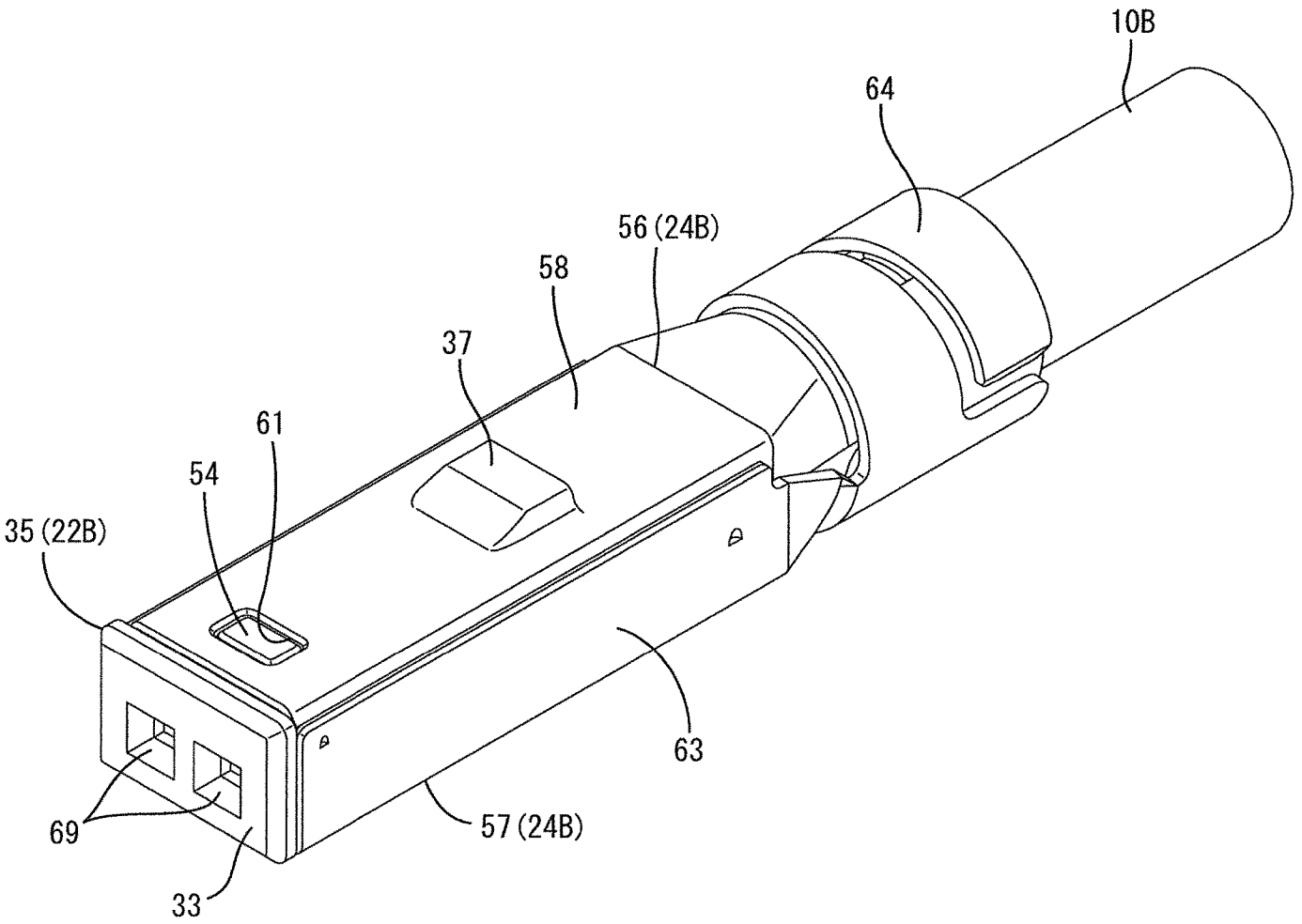
FIG. 22 is a perspective view of an outer conductor in which the upper outer conductor and the lower outer conductor are held in an assembled state and which is connected to a shield conductor of the STP cable.

The outer conductor 24B is made of a conductive metal, and includes an upper outer conductor 56 and a lower outer conductor 57 which can be divided in the up-down direction. As shown in FIG. 19, the upper outer conductor 56 has a substantially rectangular shaped upper shell part 58 in a plan view and an open barrel-shaped upper barrel portion 59 continued to the rear side of the upper shell part 58. The upper shell part 58 is disposed so as to cover the upper dielectric 35 from above. As shown in FIG. 22, a flat plate portion of the upper shell part 58 has a lock protrusion 37 in the center part in the width direction of the upper surface, and an upper positioning hole 61 is provided to be opened in front of the lock protrusion 37. Furthermore, as shown in FIG. 19, the upper shell part 58 has front and rear pairs of engaging pieces 62 which are suspended from both ends in the width direction of the flat plate portion. The upper barrel portion 59 has projecting piece portions which protrude downward from both right and left sides so as to be displaced from each other in the front-back direction.

Figure 21:
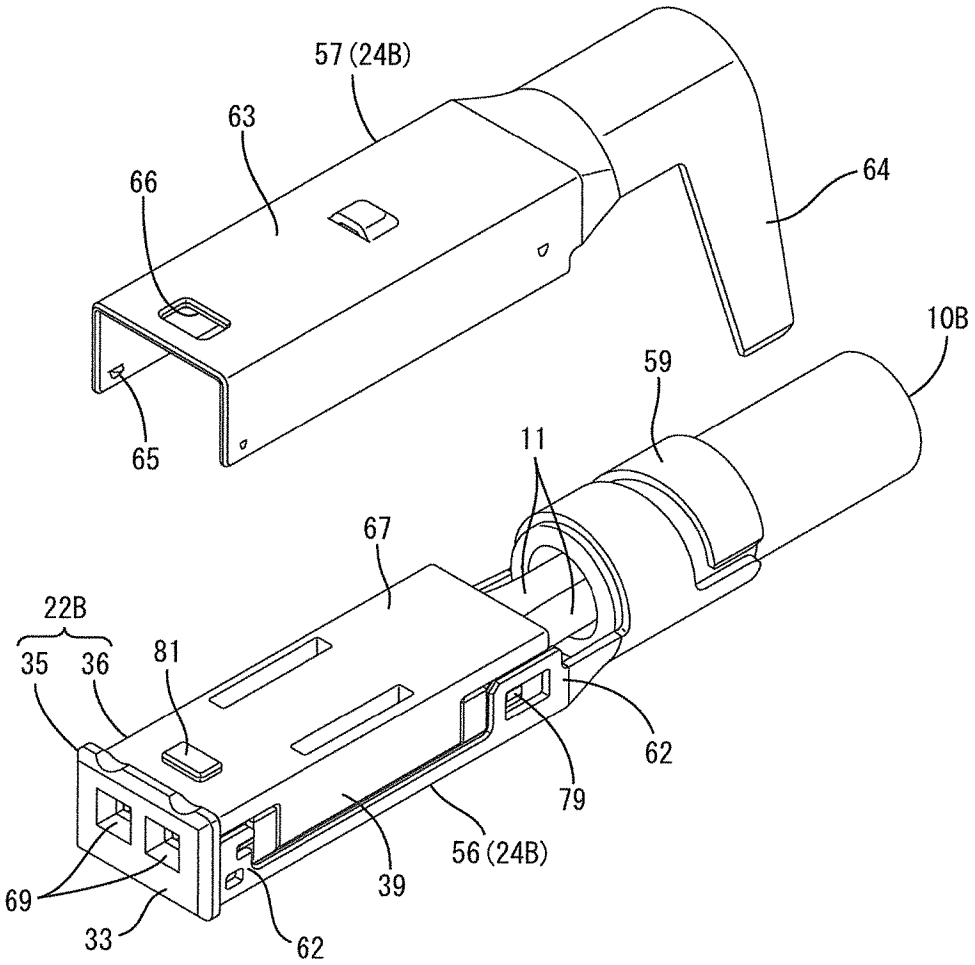
FIG. 21 is an exploded perspective view showing the upper outer conductor on which the STP dielectric is supported, and a lower outer conductor.

As shown in FIG. 21, the lower outer conductor 57 has a substantially rectangular shaped lower shell part 63 in a plan view and an open barrel-shaped lower barrel portion 64 continued to the rear side of the lower shell part 63. The lower shell part 63 is disposed so as to cover the lower dielectric 36 from the lower side. The lower shell part 63 has side plate portions which erect from both right and left ends of the flat plate portion, and has front and rear pairs of retaining protrusions 65 on the inner surfaces of the side plate portions. On the front end side of the flat plate portion of the lower shell part 63, a lower positioning hole 66 is provided to be opened. The lower barrel portion 64 has projecting piece portions which protrude upward from both right and left sides so as to be displaced from each other in the front-back direction.

[STP Housing]

Figure 23:
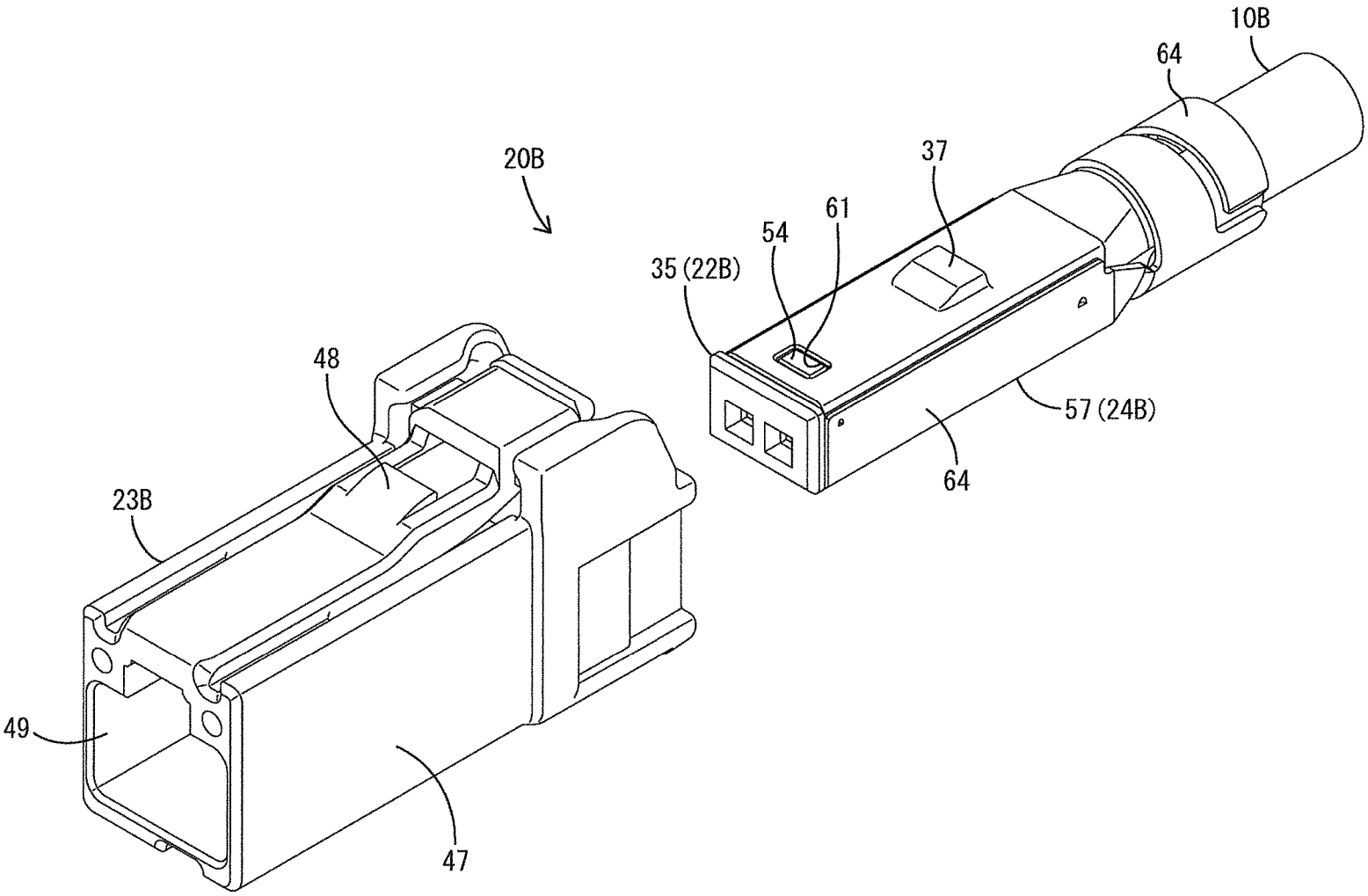
FIG. 23 is an exploded perspective view showing the outer conductor in which the STP dielectric is contained, and an STP housing.

The STP housing 23B is made of a synthetic resin, and, as shown in FIG. 23, has a substantially square-cylindrical shaped housing body 47. The STP housing 23B has the same shape as that of the UTP housing 23A and has a lock arm 48, an insertion part 49 and a lance 51 in the same arrangement as that of the UTP housing 23A. As shown in FIG. 24, a counterpart to be engaged with the lance 51 is the lock protrusion 37 of the upper outer conductor 56.

[Counterpart STP Connector]

The counterpart STP connector has substantially the same shape as that of the counterpart UTP connector, and has a pair of male terminals. The respective male terminals have a pitch width which is same as that of the respective male terminals of the counterpart UTP connector.

[Assembly of UTP Connector]

In the assembly of the UTP connector 20A, firstly, the barrel portions 28 of the UTP connection terminals 21A are connected by contact-bonding to the ends of the respective electric wires 11 of the UTP cable 10A.

Figure 3:
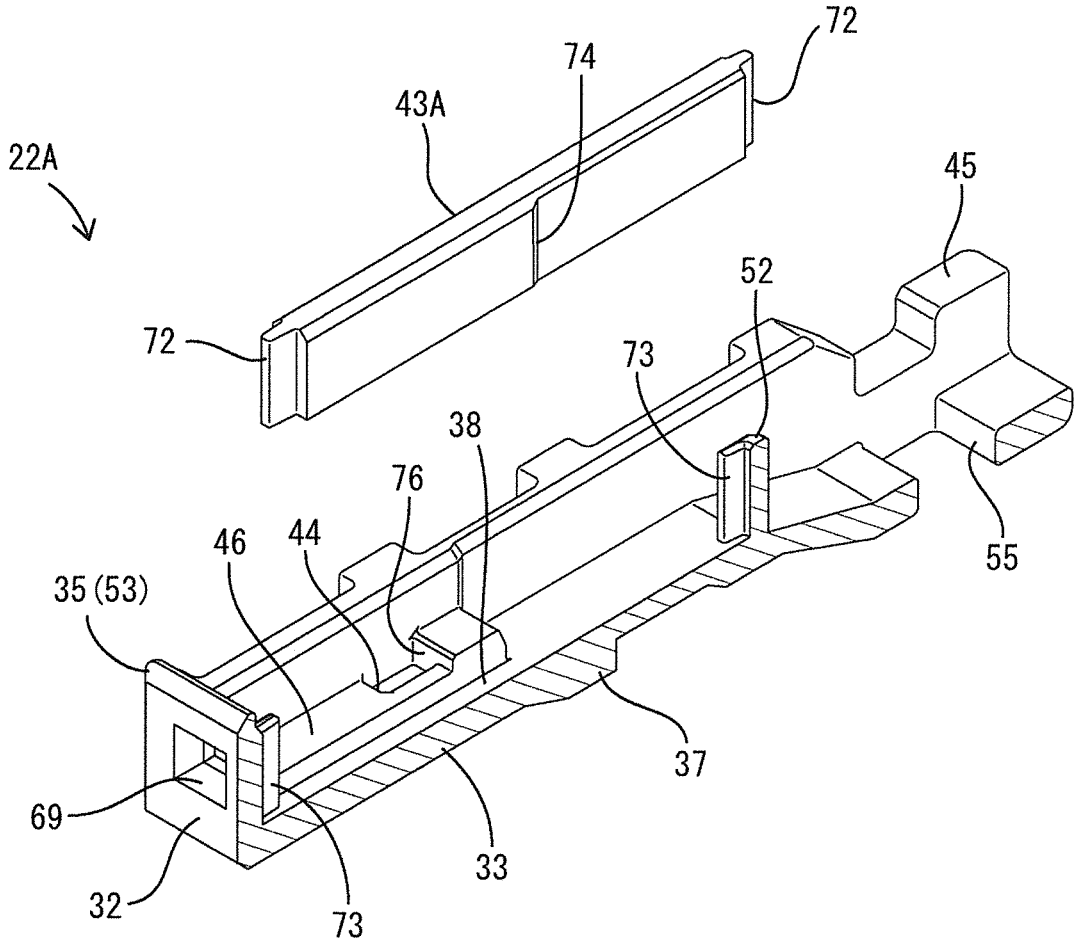
FIG. 3 is a view in which a body in FIG. 2 is cut.

Furthermore, the partition wall 43A is inserted into the fitting groove 38 of the upper dielectric 35, and positioned and held between the front wall 32 and the positioning protrusion 52 (see FIG. 2 to FIG. 4).

Subsequently, the UTP connection terminals 21A are respectively housed in the housing portions 26 which are formed on both sides of the partition wall 43A (see FIG. 5). At this time, the UTP connection terminals 21A are housed in the housing portions 26 with the protrusion thereof facing downward, and the protrusions are inserted into the concave portions 44. Then, the lower dielectric 36 is put onto the upper dielectric 35, and the mounting pieces 39 are elastically engaged with the mounting protrusions 42, whereby the upper dielectric 35 and the lower dielectric 36 are held in an assembled state (see FIG. 6 and FIG. 7).

Figure 8:
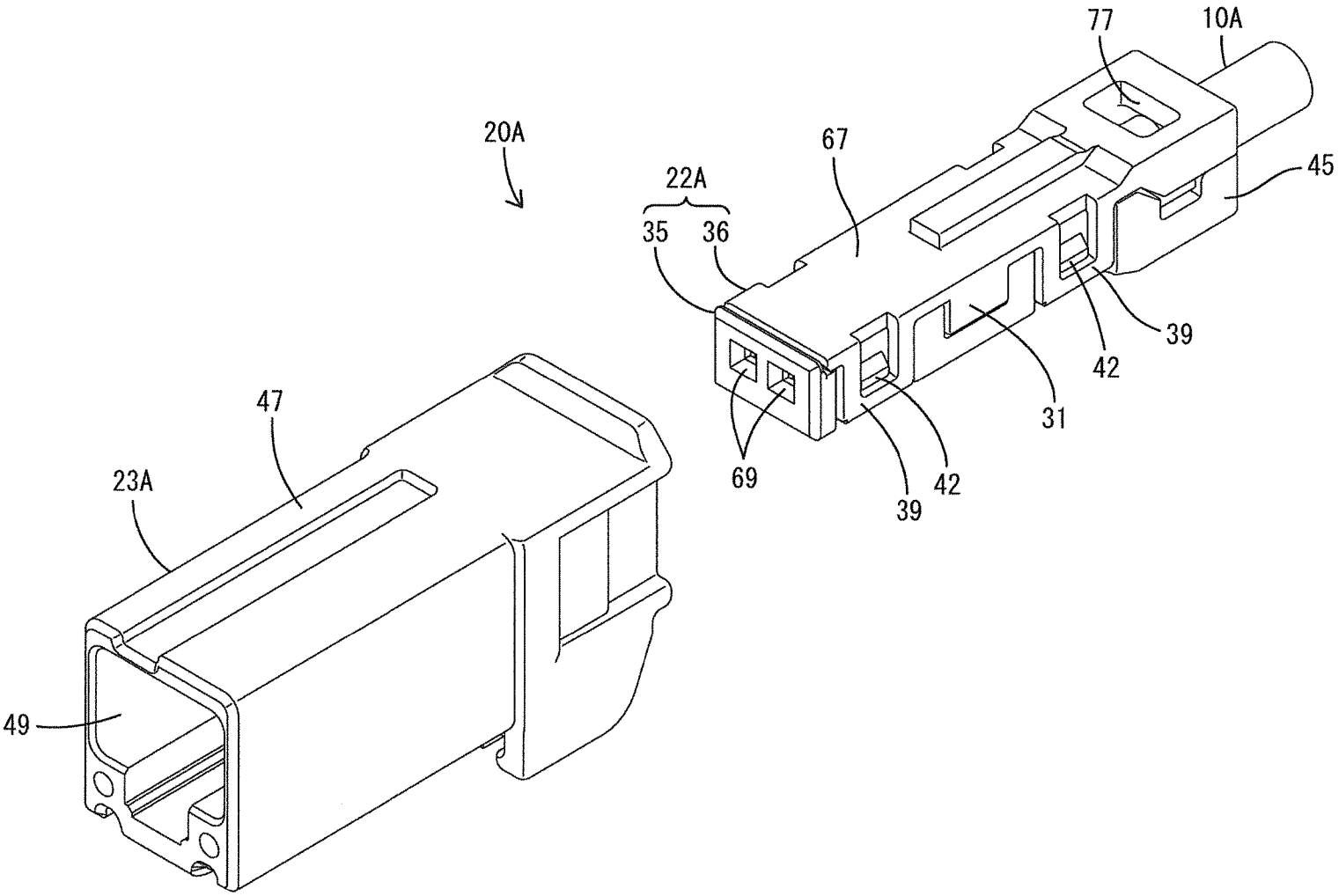
FIG. 8 is an exploded perspective view showing a UTP dielectric and a UTP housing.

Subsequently, the UTP dielectric 22A is inserted from the rear side into the insertion part 49 of the UTP housing 23A (see FIG. 8 and FIG. 9). When the UTP dielectric 22A is properly inserted into the insertion part 49, the lock protrusion 37 of the UTP dielectric 22A is elastically engaged by the lance 51, so that the UTP dielectric 22A is held in the UTP housing 23A in a retained state (see FIG. 10).

[Assembly of STP Connector]

In the assembly of the STP connector 20B, too, firstly, the barrel portions 28 of the STP connection terminals 21B are connected by contact-bonding to the ends of the respective electric wires 11 of the STP cable 10B. Furthermore, the partition wall 43B is inserted into the fitting groove 38 of the upper dielectric 35, and positioned and held between the front wall 32 and the positioning protrusion 52 (see FIG. 14 and FIG. 15).

Subsequently, the STP connection terminals 21B are respectively housed in the housing portions 26 which are formed on both sides of the partition wall 43B (see FIG. 16). At this time, the STP connection terminals 21B are housed in the housing portions 26 with the protrusions thereof facing downward, and the protrusions are inserted into the concave portions 44. Then, the lower dielectric 36 is put onto the upper dielectric 35, and the mounting pieces 39 are elastically engaged with the mounting protrusions 42, whereby the upper dielectric 35 and the lower dielectric 36 are held in an assembled state (see FIG. 17 and FIG. 18).

Figure 20:
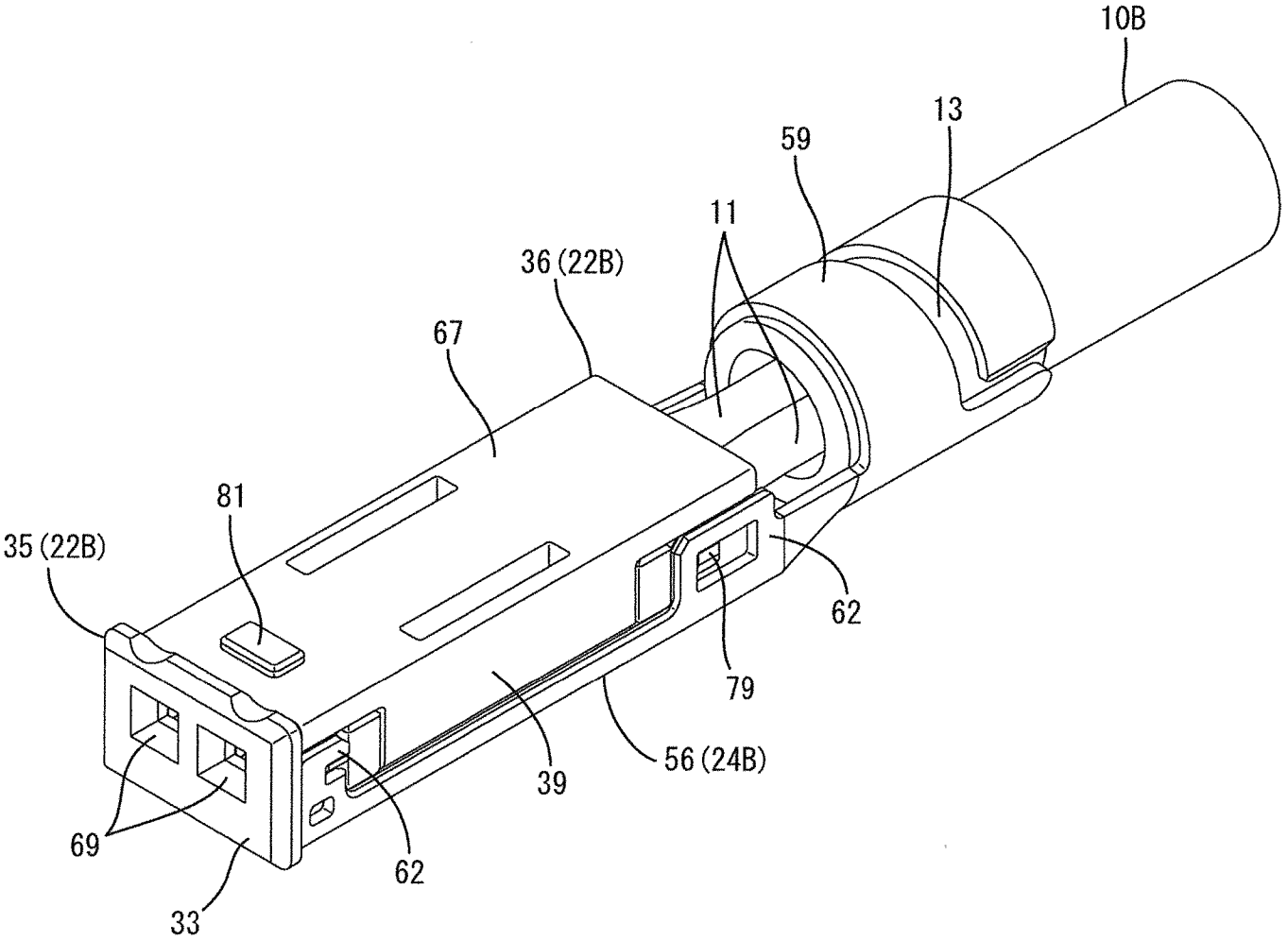
FIG. 20 is a perspective view showing a state where the STP dielectric is supported on the upper outer conductor.

Subsequently, the STP dielectric 22B is supported by the upper shell part 58 of the upper outer conductor 56 (see FIG. 19 and FIG. 20). The upper positioning protrusion 54 is fitted in the upper positioning hole 61 so that the STP dielectric 22B is positioned in the upper outer conductor 56, and the engaging protrusions 79 are engaged with the engaging pieces 62 so that the STP dielectric 22B is held in the upper outer conductor 56. Then, the upper barrel portion 59 is connected by contact-bonding to the shield conductor 13 which is exposed to the outer peripheral side of the STP cable 10B.

Thereafter, the lower outer conductor 57 is put onto the upper outer conductor 56 so as to cover the STP dielectric 22B (see FIG. 21 and FIG. 22). The side plate portions of the lower outer conductor 57 cover the engaging pieces 62 from the outside, and the lower positioning protrusion 81 is fitted in the lower positioning hole 66, so that the STP dielectric 22B is positioned in the lower outer conductor 57, and the retaining protrusions 65 are engaged with the engaging pieces 62, with the result that the upper outer conductor 56 and the lower outer conductor 57 are held in an assembled state. Then, the lower barrel portion 64 is connected by contact-bonding to the shield conductor 13 which is exposed to the outer peripheral side of the STP cable 10B. Thus, the shield conductor 13 is connected to the outer conductor 24B, and the periphery of the STP connection terminals 21B is surrounded by the outer conductor 24B via the STP dielectric 22B.

Subsequently, the outer conductor 24B in which the STP dielectric 22B is contained is inserted from the rear side into the insertion part 49 of the STP housing 23B (see FIG. 23 and FIG. 24). When the outer conductor 24B is properly inserted into the insertion part 49, the lock protrusion 37 of the outer conductor 24B is elastically engaged by the lance 51, so that the outer conductor 24B is held in the STP housing 23B in a retained state.

[Connector Fitting]

When the UTP connector 20A is properly fitted to the counterpart UTP connector, the respective male tabs are inserted and connected to the box portions 27 of the respective UTP connection terminals 21A via the tab insertion holes 69. Similarly, when the STP connector 20B is properly fitted to the counterpart STP connector, the respective male tabs are inserted and connected to the box portions 27 of the respective STP connection terminals 21B via the tab insertion holes 69. In the case of the STP connector 20B, the outer conductor 24B is connected to an earth part (not shown) which is provided in the counterpart STP connector.

The UTP dielectric 22A and the STP dielectric 22B are made of the same material except the partition walls 43A, 43B; the partition wall 43A of the UTP dielectric 22A is made of a material having a relatively high dielectric constant; and the partition wall 43B of the STP dielectric 22B is made of a material having a relatively low dielectric constant. Thus, impedance can properly be adjusted without changing the terminal-to-terminal pitches of the UTP dielectric 22A, the STP dielectric 22B, the UTP housing 23A, the STP housing 23B, the counterpart UTP connector and the counterpart STP connector, and the specification change between the UTP connector 20A and the STP connector 20B can be easily made.

Especially, the UTP connection terminals 21A and the STP connection terminals 21B are designed so as to have substantially the same shape, and the UTP housing 23A and the STP housing 23B are designed so as to have substantially the same shape. As a result, it is unnecessary to provide a plurality of types of dies when manufacturing these components, thereby making it possible to greatly reduce the cost.

Other Examples

Other Examples will be described briefly.

(1) Only the partition wall is made of a different material in Example 1. However, in the case of the present invention, the entire UTP dielectric may be made of a material having a relatively high dielectric constant, and the entire STP dielectric may be made of a material having a relatively low dielectric constant. Furthermore, the upper dielectric (dielectric having a partition wall) of the UTP dielectric may be made of a material having a relatively high dielectric constant, and the upper dielectric (dielectric having a partition wall) of the STP dielectric may be made of a material having a relatively low dielectric constant.

(2) The partition wall is provided so as to be attachable to, and detachable from, the body in Example 1. However, in the case of the present invention, the partition wall may be provided integrally with the body.

(3) Both UTP dielectric and the STP dielectric can be divided in the up-down direction in Example 1. However, in the case of the present invention, at least one of the UTP dielectric and the STP dielectric may be provided integrally in such a manner that it cannot be divided. In this case, the partition wall is preferably slid from the rear side thereby to be attached to the integrated dielectric.

(4) The outer conductor of the STP connector can be divided in the up-down direction in Example 1. However, in the case of the present invention, the outer conductor may be provided integrally so as not to be divided.

What is claimed is:

1. The electrical connector structure that selectively uses either an unshielded twisted pair (UTP) connector or a shielded twisted pair (STP) connector, the UTP connector comprising UTP connection terminals connected to respective electric wires of a UTP cable and a UTP dielectric having a pair of housing portions in which the UTP connection terminals are housed, the STP connector comprising STP connection terminals connected to respective electric wires of an STP cable and an STP dielectric having a pair of housing portions in which the STP connection terminals are housed, wherein:

in the UTP dielectric, at least a partition wall for partitioning the pair of housing portions is made of a material having a relatively high dielectric constant, in the STP dielectric, at least a partition wall for partitioning the pair of housing portions is made of a material having a relatively low dielectric constant the UTP dielectric and the STP dielectric each include an upper dielectric and a lower dielectric that can be divided and assembled in an up-down direction, one of the upper dielectric and the lower dielectric comprises a body having a fitting groove opened to the other of the upper dielectric and the lower dielectric, and the partition wall is inserted into the fitting groove of the body so as to be attachable thereto and detachable therefrom, and the upper dielectric and the lower dielectric are assembled so that the partition wall is restrained from coming out to the other side.

2. The electrical connector structure of claim 1, wherein the UTP dielectric and the STP dielectric are made from the same material, except for the partition wall is made from a material different from the material of the UTP dielectric and the STP dielectric.

3. The electrical connector structure of claim 1, wherein the UTP connector comprises a UTP housing having an insertion part in which the UTP dielectric can be inserted, and the STP connector has an STP housing having an insertion part into which the STP dielectric can be inserted, and the STP housing and the UTP housing are constructed in the same shape.

4. The electrical connector system comprising:

an unshielded twisted pair (UTP) connector having first and second UTP connection terminals connected respectively to first and second wires of a UTP cable, a UTP dielectric defining first and second UTP housing portions configured to receive the respective first and second UTP connection terminals, the UTP dielectric including an upper UTP dielectric and a lower UTP dielectric that can be divided and assembled in an up-down direction, at least one of the upper and lower UTP dielectrics having a fitting groove that is open toward the other of the upper and lower UTP dielectrics, and a UTP partition wall inserted in the fitting groove of the UTP dielectric and partitioning the first and second UTP housing portions; and a shielded twisted pair (STP) connector having first and second STP connection terminals connected respectively to first and second wires of an STP cable, an STP dielectric defining first and second STP housing portions configured for receiving the respective first and second STP connection terminals, the STP dielectric including an upper STP dielectric and a lower STP dielectric that can be divided and assembled in an up-down direction, at least one of the upper and lower STP dielectrics having a fitting groove that is open toward the other of the upper and lower STP dielectrics, and an STP partition wall inserted in the fitting groove of the STP dielectric and partitioning the first and second STP housing portions wherein, the upper and lower UTP dielectrics are formed from the same material as the upper and lower STP dielectrics, the UTP partition wall is formed from a material having a UTP dielectric constant and the STP partition wall is formed from a material having an STP dielectric constant that is lower than the UTP dielectric constant.

5. The electrical connector system of claim 4, wherein the UTP connector further comprises a UTP housing having an insertion part into which the UTP dielectric can be inserted, and the STP connector has an STP housing having an insertion part into which the STP dielectric can be inserted, the STP housing and the UTP housing having the substantially identical outer shapes.

6. The electrical connector system of claim 4, wherein the UTP partition is securely retained in the fitting groove of the UTP dielectric, and the STP partition is securely retained in the fitting groove of the STP dielectric.

* * * * *